US008689730B2

(12) United States Patent
Clifford

(10) Patent No.: US 8,689,730 B2
(45) **Date of Patent: *Apr. 8, 2014**

(54) ROBOTIC PAINTING SYSTEM AND METHOD

(75) Inventor: Scott J. Clifford, Rochester Hills, MI (US)

(73) Assignee: Fanuc Robotics America, Inc., Rochester Hills, MI (US)

( * ) Notice: Subject to any disclaimer, the term of this patent is extended or adjusted under 35 U.S.C. 154(b) by 852 days.

This patent is subject to a terminal disclaimer.

(21) Appl. No.: 12/756,569

(22) Filed: Apr. 8, 2010

(65) Prior Publication Data

US 2010/0196616 A1 Aug. 5, 2010

Related U.S. Application Data

(63) Continuation-in-part of application No. 12/187,663, filed on Aug. 7, 2008, now Pat. No. 8,051,796, which is a continuation-in-part of application No. 11/872,372, filed on Oct. 15, 2007, now Pat. No. 7,638,000, which is a continuation of application No. 10/691,939, filed on Oct. 23, 2003, now Pat. No. 7,399,363.

(60) Provisional application No. 61/167,614, filed on Apr. 8, 2009.

(51) Int. Cl.

| | |
|---|---|
| ***B05B 5/025*** | (2006.01) |
| ***B05B 5/00*** | (2006.01) |
| ***B05B 3/00*** | (2006.01) |

(52) U.S. Cl.
USPC ..... 118/629; 118/323; 118/620; 118/326; 239/690; 239/708

(58) Field of Classification Search
USPC ..... 118/323, 326, 620–640, 302; 239/112, 239/114, 106, 302–304, 352, 353, 354, 690, 239/690.1, 750–752, 223–224, 700, 704, 239/708; 901/15, 43, 27, 29, 41, 49, 50; 427/427.2, 427.3
See application file for complete search history.

(56) References Cited

U.S. PATENT DOCUMENTS

| | | | |
|---|---|---|---|
| 2,930,350 | A | 3/1960 | Gengenbach et al. |
| 4,712,739 | A | 12/1987 | Bihn |
| 4,714,635 | A | 12/1987 | Mochizuki et al. |
| 5,208,078 | A | 5/1993 | Ishibashi et al. |

(Continued)

FOREIGN PATENT DOCUMENTS

| | | |
|---|---|---|
| EP | 0 693 319 A1 | 1/1996 |
| JP | 11-267560 | 10/1999 |
| WO | WO 02/092236 A2 | 11/2002 |

*Primary Examiner* — Yewebdar Tadesse
(74) *Attorney, Agent, or Firm* — Fraser Clemens Martin & Miller LLC; William J. Clemens

(57) ABSTRACT

A robotic painting system includes an applicator, a first paint metering device in fluid communication with the applicator, a second paint metering device in fluid communication with the paint applicator, and a paint supply in fluid communication with each the paint metering devices to fill at least one of the paint metering devices with a desired amount of paint, wherein each of the paint metering devices is electrostatically isolated from the paint supply, and wherein a color change time and a paint waste are minimized and a cleaning operation of the system is optimized.

16 Claims, 21 Drawing Sheets

(56) References Cited

U.S. PATENT DOCUMENTS

| | | | | |
|---|---|---|---|---|
| 5,293,911 | A | 3/1994 | Akeel | |
| 5,320,283 | A | 6/1994 | Hollstein et al. | |
| 5,367,944 | A | 11/1994 | Akeel et al. | |
| 5,536,315 | A | 7/1996 | Guzowski et al. | |
| 6,284,047 | B1 * | 9/2001 | Yoshida et al. | 118/629 |
| 6,641,667 | B2 * | 11/2003 | Ochiai et al. | 118/323 |
| 7,328,862 | B2 | 2/2008 | Takebe et al. | |
| 7,638,000 | B2 | 12/2009 | Clifford et al. | |
| 8,051,796 | B2 * | 11/2011 | Clifford | 118/323 |
| 2001/0013315 | A1 | 8/2001 | Klein et al. | |
| 2002/0043280 | A1 | 4/2002 | Ochiai et al. | |
| 2003/0042340 | A1 * | 3/2003 | Clifford et al. | 239/690 |
| 2004/0115360 | A1 | 6/2004 | Clifford et al. | |
| 2006/0292308 | A1 * | 12/2006 | Clifford et al. | 427/427.2 |
| 2008/0083371 | A1 | 4/2008 | Clifford et al. | |
| 2008/0217442 | A1 | 9/2008 | Anfindsen et al. | |
| 2009/0017212 | A1 | 1/2009 | Clifford | |

* cited by examiner

| Canister System 1 | | | | | | | | | | | | | | | | | | | | | | | |
|---|---|---|---|---|---|---|---|---|---|---|---|---|---|---|---|---|---|---|---|---|---|---|---|
| Step # | DUR Time (sec) | Start Time (sec) | Finish Time (sec) | Description | Can 1 Move Start (ml) | Can 1 Move Finish (ml) | pAIR 754 | pSOL 758 | pWASH3 757 | pWASH1 755 | pDUMP 726 | pVAC 749 | pSOL2 759 | pCOL1 712 | pCOL2 712 | pPAINT1 718 | pCAN1 729 | pWASH1-1 732 | pWASH1-2 733 | pPAINT1-1 730 | pIW1 742 | pTRIG1 745 |
| 1 | 0.5 | 0 | 0.5 | Vacuum CAN 1 | 1 | 1 | | | | | | O | | | | O | O | | | O | | |
| 2 | 15 | 0.5 | 15.5 | Fill CAN 1 | 1 | 585 | | | | | | | | O | | O | O | | | O | | |
| 3 | 1 | 15.5 | 16.5 | Push ISO 1 | 585 | 595 | | | | | | | O | | | O | O | | | | | |
| 4 | 1.5 | 16.5 | 18 | Clean ISO 1 | 595 | 595 | O | O | | O | O | | | | | O | | O | | | | |
| 5 | 4 | 18 | 22 | Dry ISO 1 | 595 | 593 | O | | | O | O | | | | | O | | O | | | | |
| 6 | 60 | 22 | 82 | Paint COL1 on CAR1 | 593 | 393 | | | | | | | | | | | | | | | | O |
| 7 | 60 | 82 | 142 | Paint COL1 on CAR2 | 393 | 193 | | | | | | | | | | | | | | | | O |
| 8 | 58.5 | 142 | 200.5 | Paint COL1 on CAR3 | 193 | 0 | | | | | | | | | | | | | | | | O |
| 9 | 1.5 | 200.5 | 202 | Push Paint1 on CAR3 | 0 | 0 | O | | | O | | | | | | | O | O | | O | | O |
| 10 | 6 | 202 | 208 | Clean INJ 1 | 0 | 0 | O | O | | O | O | | | | | O | O | | O | O | O | O |
| 11 | 5 | 208 | 213 | Dry INJ 1 | 0 | 0 | O | | | O | O | | | | | O | O | | O | O | O | O |
| 12 | 0 | 213 | 213 | Nothing | 0 | 1 | | | | | | | | | | | | | | | | |
| 13 | 0 | 213 | 213 | Nothing | 1 | 1 | | | | | | | | | | | | | | | | |
| 14 | 0.5 | 213 | 213.5 | Vacuum CAN 1 | 1 | 1 | | | | | | O | | | | O | O | | | O | | |
| 15 | 15 | 213.5 | 228.5 | Fill CAN 1 | 1 | 585 | | | | | | | | | O | O | O | | | O | | |
| 16 | 1 | 228.5 | 229.5 | Push ISO 1 | 585 | 595 | | | | | | | O | | | O | O | | | | | |
| 17 | 1.5 | 229.5 | 231 | Clean ISO 1 | 595 | 595 | O | O | | O | O | | | | | O | | O | | | | |
| 18 | 2 | 231 | 233 | Dry ISO 1/Fill INJ 1 | 595 | 593 | O | | | O | O | | | | | O | | O | | | | |
| 19 | 60 | 404 | 464 | Paint COL1 on CAR7 | 593 | 393 | | | | | | | | | | | | | | | | O |
| 20 | 60 | 464 | 524 | Paint COL1 on CAR8 | 393 | 193 | | | | | | | | | | | | | | | | O |
| 21 | 58.5 | 524 | 582.5 | Paint COL1 on CAR9 | 193 | 0 | | | | | | | | | | | | | | | | O |
| 22 | 1.5 | 582.5 | 584 | Push Paint1 on CAR9 | 0 | 0 | O | | | O | | | | | | | O | O | | O | | O |
| 23 | 6 | 584 | 590 | Clean INJ 1 | 0 | 1 | O | O | | O | O | | | | | O | O | | O | O | O | O |
| 24 | 5 | 590 | 595 | Dry INJ 1 | 1 | 1 | O | | | O | O | | | | | O | O | | O | O | O | O |
| 25 | 0 | 595 | 595 | Nothing | 1 | 1 | | | | | | | | | | | | | | | | |
| 26 | 0 | 595 | 595 | Nothing | 1 | 1 | | | | | | | | | | | | | | | | |

FIG - 9

| Canister System 2 | | | | | | | | | | | | | | | | | | | | | | |
|---|---|---|---|---|---|---|---|---|---|---|---|---|---|---|---|---|---|---|---|---|---|---|
| Step # | DUR Time (sec) | Start Time (sec) | Finish Time (sec) | Description | Can 2 Move Start (ml) | Can 2 Move Finish (ml) | pAIR 754 | pSOL 758 | pWASH3 757 | pWASH2 756 | pDUMP 726 | pVAC 749 | pSOL2 759 | pCOL1 712 | pCOL2 712 | pPAINT2 719 | pCAN-2 735 | pWASH2-1 738 | pWASH2-2 739 | pPAINT2-2 736 | pIW 2 743 | pTRIG2 746 |
| 1 | 0.5 | 21 | 21.5 | Vacuum CAN 2 | 0 | 1 | | | | | | O | | | | O | O | | | O | | |
| 2 | 15 | 21.5 | 36.5 | Fill CAN 2 | 1 | 585 | | | | | | | | | O | O | O | | | O | | |
| 3 | 1 | 36.5 | 37.5 | Push ISO 2 | 585 | 595 | | | | | | | O | | | O | O | | | | | |
| 4 | 1.5 | 37.5 | 39 | Clean ISO 2 | 595 | 595 | O | O | | O | O | | | | | O | | O | | | | |
| 5 | 4 | 39 | 43 | Dry ISO 2 | 595 | 593 | O | | | O | O | | | | | O | | O | | | | |
| 6 | 60 | 213 | 273 | Paint COL2 on CAR4 | 593 | 393 | | | | | | | | | | | | | | | | O |
| 7 | 60 | 273 | 333 | Paint COL2 on CAR5 | 393 | 193 | | | | | | | | | | | | | | | | O |
| 8 | 58.5 | 333 | 391.5 | Paint COL2 on CAR6 | 193 | 0 | | | | | | | | | | | | | | | | O |
| 9 | 1.5 | 391.5 | 393 | Push Paint2 on CAR6 | 0 | 0 | O | | | O | | | | | | | O | O | | O | | O |
| 10 | 6 | 393 | 399 | Clean CAN 2 | 0 | 1 | O | O | | O | O | | | | | O | O | | O | O | O | O |
| 11 | 5 | 399 | 404 | Dry CAN 2 | 1 | 1 | O | | | O | O | | | | | O | O | | O | O | O | O |
| 12 | 0.5 | 405 | 405.5 | Vacuum CAN 2 | 1 | 1 | | | | | | O | | | | O | O | | | O | | |
| 13 | 15 | 405.5 | 420.5 | Fill CAN 2 | 1 | 585 | | | | | | | | | O | O | O | | | O | | |
| 14 | 1 | 406.5 | 407.5 | Push ISO 2 | 585 | 595 | | | | | | | O | | | O | O | | | | | |
| 15 | 1.5 | 408 | 409.5 | Clean ISO 2 | 595 | 595 | O | O | | O | O | | | | | O | | O | | | | |
| 16 | 4 | 412 | 416 | Dry ISO 2 | 595 | 593 | O | | | O | O | | | | | O | | O | | | | |
| 17 | 60 | 595 | 655 | Paint COL2 on CAR10 | 593 | 393 | | | | | | | | | | | | | | | | O |
| 18 | 60 | 655 | 715 | Paint COL2 on CAR11 | 393 | 193 | | | | | | | | | | | | | | | | O |
| 19 | 58.5 | 713.5 | 772 | Paint COL2 on CAR12 | 193 | 0 | | | | | | | | | | | | | | | | O |
| 20 | 1.5 | 715 | 716.5 | Push Paint2 on CAR12 | 0 | 0 | O | | | O | | | | | | | O | O | | O | | O |
| 21 | 6 | 721 | 727 | Clean CAN 2 | 0 | 1 | O | O | | O | O | | | | | O | O | | O | O | O | O |
| 22 | 5 | 726 | 731 | Dry CAN 2 | 1 | 1 | O | | | O | O | | | | | O | O | | O | O | O | O |

FIG - 10

| Canister System 1 | | | | | | | | | | | | | | | | | | | | | | | | |
|---|---|---|---|---|---|---|---|---|---|---|---|---|---|---|---|---|---|---|---|---|---|---|---|---|
| Step # | DUR Time (sec) | Start Time (sec) | Finish Time (sec) | Description | Can 1 Move Start (ml) | Can 1 Move Finish (ml) | pAIR 854 | pSOL 858 | pWASH1 855 | pDUMP 826 | pVAC 848 | pSOL2 859 | pCOL1 812 | pCOL2 812 | pPAINT1 818 | pCAN-1 830 | pWASH1-1 833 | pWASH1-2 834 | pPAINT1-1 831 | pWASH1-3 835 | pIW1 842 | pTRIG1 844 |
| 1 | 0.5 | 0 | 0.5 | Vacuum CAN 1 | 1 | 1 | | | | | O | | | | O | O | | | O | | | |
| 2 | 15 | 0.5 | 15.5 | Fill CAN 1 | 1 | 585 | | | | | | | O | | O | O | | | O | | | |
| 3 | 1 | 15.5 | 16.5 | Push ISO 1 | 585 | 595 | | | | | | O | | | O | O | | | | | | |
| 4 | 1.5 | 16.5 | 18 | Clean ISO 1 | 595 | 595 | O | O | O | O | | | | | O | | O | | | | | |
| 5 | 4 | 18 | 22 | Dry ISO 1 | 595 | 593 | O | | O | O | | | | | O | | O | | | | | |
| 6 | 60 | 22 | 82 | Paint COL1 on CAR1 | 593 | 393 | | | | | | | | | | | | | | | | O |
| 7 | 60 | 82 | 142 | Paint COL1 on CAR2 | 393 | 193 | | | | | | | | | | | | | | | | O |
| 8 | 58.5 | 142 | 200.5 | Paint COL1 on CAR3 | 193 | 0 | | | | | | | | | | | | | | | | O |
| 9 | 1.5 | 200.5 | 202 | Push Paint1 on CAR3 | 0 | 0 | O | | O | | | | | | | O | O | | O | | | O |
| 10 | 3 | 202 | 205 | Clean PAINT 1 | 0 | 0 | O | O | O | O | | | | | O | O | | | O | O | O | O |
| 11 | 2.5 | 205 | 207.5 | Dry PAINT 1 | 0 | 0 | O | | O | O | | | | | O | O | | | O | O | O | O |
| 12 | 3 | 207.5 | 210.5 | Clean CAN1 | 0 | 1 | O | O | O | O | | | | | O | O | | O | | | | |
| 13 | 2.5 | 210.5 | 213 | Dry CAN1 | 1 | 1 | O | | O | O | | | | | O | O | | O | | | | |
| 14 | 0.5 | 207.5 | 208 | Vacuum CAN 1 | 1 | 1 | | | | | O | | | | O | O | | | O | | | |
| 15 | 15 | 208 | 223 | Fill CAN 1 | 1 | 585 | | | | | | | | O | O | O | | | O | | | |
| 16 | 1 | 223 | 224 | Push ISO 1 | 585 | 595 | | | | | | O | | | O | O | | | | | | |
| 17 | 1.5 | 224 | 225.5 | Clean ISO 1 | 595 | 595 | O | O | O | O | | | | | O | | O | | | | | |
| 18 | 4 | 225.5 | 229.5 | Dry ISO 1 | 595 | 593 | O | | O | O | | | | | O | | O | | | | | |
| 19 | 60 | 393 | 453 | Paint COL1 on CAR7 | 593 | 393 | | | | | | | | | | | | | | | | O |
| 20 | 60 | 453 | 513 | Paint COL1 on CAR8 | 393 | 193 | | | | | | | | | | | | | | | | O |
| 21 | 58.5 | 513 | 571.5 | Paint COL1 on CAR9 | 193 | 0 | | | | | | | | | | | | | | | | O |
| 22 | 1.5 | 571.5 | 573 | Push Paint1 on CAR9 | 0 | 0 | O | | O | | | | | | | O | O | | O | | | O |
| 23 | 3 | 573 | 576 | Clean PAINT1 | 0 | 1 | O | O | O | O | | | | | O | O | | | O | O | O | O |
| 24 | 2.5 | 576 | 578.5 | Dry PAINT1 | 1 | 1 | O | | O | O | | | | | O | O | | | O | O | O | O |
| 25 | 3 | 578.5 | 581.5 | Clean CAN1 | 1 | 1 | O | O | O | O | | | | | O | O | | O | | | | |
| 26 | 2.5 | 581.5 | 595 | Dry CAN1 | 1 | 1 | O | | O | O | | | | | O | O | | O | | | | |

FIG - 12

| Canister System 1 | | | | | | | | | | | | | | | | | | | | | | | |
|---|---|---|---|---|---|---|---|---|---|---|---|---|---|---|---|---|---|---|---|---|---|---|---|
| Step # | DUR Time (sec) | Start Time (sec) | Finish Time (sec) | Description | Can 1 Move Start (ml) | Can 1 Move Finish (ml) | pAIR 854 | pSOL 858 | pWASH2 826 | pDUMP 848 | pVAC 848 | pSOL2 859 | pCOL1 812 | pCOL2 812 | pPAINT2 819 | pCAN-2 836 | pWASH1-4 839 | pWASH1-5 840 | pPAINT2-2 837 | pWASH1-3 835 | pIW 1 842 | pTRIG2 845 |
| 1 | 0.5 | 21 | 21.5 | Vacuum CAN 1 | 1 | 1 | | | | | O | | | | O | O | | | O | | | |
| 2 | 15 | 21.5 | 36.5 | Fill CAN 1 | 1 | 585 | | | | | | | O | | O | O | | | O | | | |
| 3 | 1 | 36.5 | 37.5 | Push ISO 1 | 585 | 595 | | | | | | O | | | O | O | | | | | | |
| 4 | 1.5 | 37.5 | 39 | Clean ISO 1 | 595 | 595 | O | O | O | O | | | | | O | | O | | | | | |
| 5 | 4 | 39 | 43 | Dry ISO 1 | 595 | 593 | O | | O | O | | | | | O | | O | | | | | |
| 6 | 60 | 207.5 | 267.5 | Paint COL1 on CAR1 | 593 | 393 | | | | | | | | | | | | | | | | O |
| 7 | 60 | 267.5 | 327.5 | Paint COL1 on CAR2 | 393 | 193 | | | | | | | | | | | | | | | | O |
| 8 | 58.5 | 327.5 | 386 | Paint COL1 on CAR3 | 193 | 0 | | | | | | | | | | | | | | | | O |
| 9 | 1.5 | 386 | 387.5 | Push Paint1 on CAR3 | 0 | 0 | O | | O | | | | | | | O | O | | O | | | O |
| 10 | 3 | 387.5 | 390.5 | Clean PAINT 1 | 0 | 0 | O | O | O | O | | | | | O | O | | | O | O | O | O |
| 11 | 2.5 | 390.5 | 393 | Dry PAINT 1 | 0 | 0 | O | | O | O | | | | | O | O | | | O | O | O | O |
| 12 | 3 | 393 | 396 | Clean CAN1 | 0 | 1 | O | O | O | O | | | | | O | O | | O | | | | |
| 13 | 2.5 | 396 | 398.5 | Dry CAN1 | 1 | 1 | O | | O | O | | | | | O | O | | O | | | | |
| 14 | 0.5 | 398.5 | 399 | Vacuum CAN 1 | 1 | 1 | | | | | O | | | | O | O | | | O | | | |
| 15 | 15 | 399 | 414 | Fill CAN 1 | 1 | 585 | | | | | | | | O | O | O | | | O | | | |
| 16 | 1 | 414 | 415 | Push ISO 1 | 585 | 595 | | | | | | O | | | O | O | | | | | | |
| 17 | 1.5 | 415 | 416.5 | Clean ISO 1 | 595 | 595 | O | O | O | O | | | | | O | | O | | | | | |
| 18 | 4 | 416.5 | 420.5 | Dry ISO 1 | 595 | 593 | O | | O | O | | | | | O | | O | | | | | |
| 19 | 60 | 578.5 | 638.5 | Paint COL1 on CAR10 | 593 | 393 | | | | | | | | | | | | | | | | O |
| 20 | 60 | 638.5 | 698.5 | Paint COL1 on CAR11 | 393 | 193 | | | | | | | | | | | | | | | | O |
| 21 | 58.5 | 698.5 | 757 | Paint COL1 on CAR12 | 193 | 0 | | | | | | | | | | | | | | | | O |
| 22 | 1.5 | 757 | 758.5 | Push Paint1 on CAR12 | 0 | 0 | O | | O | | | | | | | O | O | | O | | | O |
| 23 | 3 | 758.5 | 761.5 | Clean PAINT1 | 0 | 1 | O | O | O | O | | | | | O | O | | | O | O | O | O |
| 24 | 2.5 | 761.5 | 764 | Dry PAINT1 | 1 | 1 | O | | O | O | | | | | O | O | | | O | O | O | O |
| 25 | 3 | 764 | 767 | Clean CAN1 | 0 | 1 | O | O | O | O | | | | | O | O | | O | | | | |
| 26 | 2.5 | 767 | 769.5 | Dry CAN1 | 1 | 1 | O | | O | O | | | | | O | O | | O | | | | |

FIG - 13

| Canister System 1 | | | | | | | | | | | | | | | | | | | | | | | |
|---|---|---|---|---|---|---|---|---|---|---|---|---|---|---|---|---|---|---|---|---|---|---|---|
| Step # | DUR Time (sec) | Start Time (sec) | Finish Time (sec) | Description | Can 1 Move Start (ml) | Can 1 Move Finish (ml) | pAIR 954 | pSOL 958 | pWASH 3 957 | pWASH 1 955 | pDUMP 926 | pVAC 948 | pSOL2 959 | pCOL1 912 | pCOL 2 912 | pPAINT1 918 | pCAN-1 929 | pWASH1-1 930 | pIW 1 941 | pPE 1 943 | pTRIG 1 945 |
| 1 | 0.5 | 0 | 0.5 | Vacuum CAN 1 | 1 | 1 | | | | | | O | | | | O | O | | | O | |
| 2 | 15 | 0.5 | 15.5 | Fill CAN 1 | 1 | 585 | | | | | | | | O | | O | O | | | O | |
| 3 | 1 | 15.5 | 16.5 | Push ISO 1 | 585 | 595 | | | | | | | O | | | O | O | | | | |
| 4 | 1.5 | 16.5 | 18 | Clean ISO 1 | 595 | 595 | O | O | | O | O | | | | | O | | O | | | |
| 5 | 4 | 18 | 22 | Dry ISO 1 | 595 | 593 | O | | | O | O | | | | | O | | O | | O | O |
| 6 | 60 | 22 | 82 | Paint COL1 on CAR1 | 593 | 393 | | | | | | | | | | | | | | O | O |
| 7 | 60 | 82 | 142 | Paint COL1 on CAR2 | 393 | 193 | | | | | | | | | | | | | | O | O |
| 8 | 58.5 | 142 | 200.5 | Paint COL1 on CAR3 | 193 | 0 | | | | | | | | | | | | | | O | O |
| 9 | 1.5 | 200.5 | 202 | Push Paint1 on CAR3 | 0 | 0 | O | | | O | | | | | | | O | O | | O | O |
| 10 | 0.5 | 202 | 202.5 | Clean INJ 1 | 0 | 0 | O | O | | O | | | | | | | | | O | | O |
| 11 | 1.5 | 202.5 | 204 | Dry INJ 1 | 0 | 0 | O | | | O | | | | | | | | | O | | O |
| 12 | 4 | 204 | 208 | Clean CAN 1 | 0 | 1 | O | O | | O | O | | | | | O | O | | O | O | |
| 13 | 5 | 208 | 213 | Dry CAN 1 | 1 | 1 | O | | | O | O | | | | | O | O | | O | O | |
| 14 | 0.5 | 213 | 213.5 | Vacuum CAN 1 | 1 | 1 | | | | | | O | | | | O | O | | | O | |
| 15 | 15 | 213.5 | 228.5 | Fill CAN 1 | 1 | 585 | | | | | | | | | O | O | O | | | O | |
| 16 | 1 | 228.5 | 229.5 | Push ISO 1 | 585 | 595 | | | | | | | O | | | O | O | | | | |
| 17 | 1.5 | 229.5 | 231 | Clean ISO 1 | 595 | 595 | O | O | | O | O | | | | | O | | O | | | |
| 18 | 2 | 231 | 386 | Dry ISO 1/Fill INJ 1 | 595 | 593 | O | | | O | O | | | | | O | | O | | | |
| 19 | 60 | 386 | 446 | Paint COL1 on CAR7 | 593 | 393 | O | | | O | O | | | | | O | | O | | O | O |
| 20 | 60 | 446 | 506 | Paint COL1 on CAR8 | 393 | 193 | | | | | | | | | | | | | | O | O |
| 21 | 58.5 | 506 | 564.5 | Paint COL1 on CAR9 | 193 | 0 | | | | | | | | | | | | | | O | O |
| 22 | 1.5 | 564.5 | 566 | Push Paint1 on CAR9 | 0 | 0 | O | | | O | | | | | | | O | O | | O | O |
| 23 | 0.5 | 566 | 566.5 | Clean INJ 1 | 0 | 0 | O | O | | O | | | | | | | | | O | | O |
| 24 | 1.5 | 566.5 | 568 | Dry INJ 1 | 0 | 0 | O | | | O | | | | | | | | | O | | O |
| 25 | 4 | 568 | 572 | Clean CAN 1 | 0 | 1 | O | O | | O | O | | | | | O | O | | O | O | |
| 26 | 5 | 572 | 577 | Dry CAN 1 | 1 | 1 | O | | | O | O | | | | | O | O | | O | O | |

FIG - 15

| Canister System 2 | | | | | | | | | | | | | | | | | | | | | | |
|---|---|---|---|---|---|---|---|---|---|---|---|---|---|---|---|---|---|---|---|---|---|---|
| Step # | DUR Time (sec) | Start Time (sec) | Finish Time (sec) | Description | Can 2 Move Start (ml) | Can 2 Move Finish (ml) | pAIR 954 | pSOL 958 | pWASH 3 957 | pWASH 2 956 | pDUMP 926 | pVAC 948 | pSOL2 959 | pCOL1 912 | pCOL2 912 | pPAINT2 919 | pCAN 2 933 | pWASH2-1 934 | pIW2 942 | pPE2 944 | pTRIG2 946 |
| 1 | 0.5 | 21 | 21.5 | Vacuum CAN 2 | 0 | 1 | | | | | | O | | | | O | O | | | O | |
| 2 | 15 | 21.5 | 36.5 | Fill CAN 2 | 1 | 585 | | | | | | | | | O | O | O | | | O | |
| 3 | 1 | 36.5 | 37.5 | Push ISO 2 | 585 | 595 | | | | | | | O | | | O | O | | | | |
| 4 | 1.5 | 37.5 | 39 | Clean ISO 2 | 595 | 595 | O | O | | O | O | | | | | O | | O | | | |
| 5 | 4 | 39 | 43 | Dry ISO 2 | 595 | 593 | O | | | O | O | | | | | O | | O | | | |
| 6 | 60 | 204 | 264 | Paint COL2 on CAR2 | 593 | 393 | | | | | | | | | | | | | | O | O |
| 7 | 60 | 264 | 324 | Paint COL2 on CAR2 | 393 | 193 | | | | | | | | | | | | | | O | O |
| 8 | 59.5 | 324 | 383.5 | Paint COL2 on CAR3 | 193 | 0 | | | | | | | | | | | | | | O | O |
| 9 | 0.5 | 383.5 | 384 | Push Paint2 on CAR3 | 0 | 0 | O | | | O | | | | | | | O | O | | O | O |
| 10 | 0.5 | 384 | 384.5 | Clean INJ 2 | 0 | 0 | O | O | | O | | | | | | | | | O | | O |
| 11 | 1.5 | 384.5 | 386 | Dry INJ 2 | 0 | 0 | O | | | O | | | | | | | | | O | | O |
| 12 | 0.5 | 387 | 387.5 | Vacuum CAN 2 | 0 | 1 | | | | | | O | | | | O | | | | O | |
| 13 | 15 | 387.5 | 402.5 | Fill CAN 2 | 1 | 585 | | | | | | | | | O | O | O | | | O | |
| 14 | 1 | 388.5 | 389.5 | Push ISO 2 | 585 | 595 | | | | | | | O | | | O | O | | | | |
| 15 | 1.5 | 390 | 391.5 | Clean ISO 2 | 595 | 595 | O | O | | O | O | | | | | O | | O | | | |
| 16 | 4 | 394 | 398 | Dry ISO 2 | 595 | 593 | O | | | O | O | | | | | O | | O | | | |
| 17 | 60 | 568 | 628 | Paint COL2 on CAR10 | 593 | 393 | | | | | | | | | | | | | | O | O |
| 18 | 60 | 628 | 688 | Paint COL2 on CAR11 | 393 | 193 | | | | | | | | | | | | | | O | O |
| 19 | 59.5 | 687.5 | 747 | Paint COL2 on CAR12 | 193 | 0 | | | | | | | | | | | | | | O | O |
| 20 | 0.5 | 688 | 688.5 | Push Paint2 on CAR12 | 0 | 0 | O | | | O | | | | | | | O | O | | O | O |
| 21 | 0.5 | 688.5 | 689 | Clean INJ 2 | 0 | 0 | O | O | | O | | | | | | | | | O | | O |
| 22 | 1.5 | 690 | 691.5 | Dry INJ 2 | 0 | 0 | O | | | O | | | | | | | | | O | | O |

FIG - 16

| Canister System 1 | | | | | | | | | | | | | | | | | | | | | | | |
|---|---|---|---|---|---|---|---|---|---|---|---|---|---|---|---|---|---|---|---|---|---|---|---|
| Step # | DUR Time (sec) | Start Time (sec) | Finish Time (sec) | Description | Can 1 Move Start (ml) | Can 1 Move Finish (ml) | pAIR 1054 | pSOL 1058 | pWASH 3 1057 | pWASH 1 1055 | pDUMP 1026 | pVAC 1049 | pSOL2 1059 | pCOL1 1012 | pCOL2 1012 | pPAINT1 1018 | pCAN-1 1029 | pWASH1-11032 | pWASH1-21033 | pPAINT1-1 1030 | pW1 1044 | pTRIG1 1047 |
| 1 | 0.5 | 0 | 0.5 | Vacuum CAN 1 | 1 | 1 | | | | | | O | | | | O | O | | | O | | |
| 2 | 15 | 0.5 | 15.5 | Fill CAN 1 | 1 | 585 | | | | | | | | O | | O | O | | | O | | |
| 3 | 1 | 15.5 | 16.5 | Push ISO 1 | 585 | 595 | | | | | | | O | | | O | O | | | | | |
| 4 | 1.5 | 16.5 | 18 | Clean ISO 1 | 595 | 595 | O | O | | O | O | | | | | O | | O | | | | |
| 5 | 4 | 18 | 22 | Dry ISO 1 | 595 | 593 | O | | | O | O | | | | | O | | O | | | | |
| 6 | 60 | 22 | 82 | Paint COL1 on CAR1 | 593 | 393 | | | | | | | | | | | | | | | | O |
| 7 | 60 | 82 | 142 | Paint COL1 on CAR2 | 393 | 193 | | | | | | | | | | | | | | | | O |
| 8 | 58.5 | 142 | 200.5 | Paint COL1 on CAR3 | 193 | 0 | | | | | | | | | | | | | | | | O |
| 9 | 1.5 | 200.5 | 202 | Push Paint1 on CAR3 | 0 | 0 | O | | | O | | | | | | | O | O | | O | | O |
| 10 | 0.5 | 202 | 202.5 | Clean INJ 1 | 0 | 0 | O | O | | O | | | | | | | | | O | | O | O |
| 11 | 1.5 | 202.5 | 204 | Dry INJ 1 | 0 | 0 | O | | | O | | | | | | | | | O | | O | O |
| 12 | 4 | 204 | 208 | Clean CAN 1 | 0 | 1 | O | O | | O | O | | | | | O | O | | O | | O | |
| 13 | 5 | 208 | 213 | Dry CAN 1 | 1 | 1 | O | | | O | O | | | | | O | O | | O | | O | |
| 14 | 0.5 | 213 | 213.5 | Vacuum CAN 1 | 1 | 1 | | | | | | O | | | | O | O | | | O | | |
| 15 | 15 | 213.5 | 228.5 | Fill CAN 1 | 1 | 585 | | | | | | | | | O | O | O | | | O | | |
| 16 | 1 | 228.5 | 229.5 | Push ISO 1 | 585 | 595 | | | | | | | O | | | O | O | | | | | |
| 17 | 1.5 | 229.5 | 231 | Clean ISO 1 | 595 | 595 | O | O | | O | O | | | | | O | | O | | | | |
| 18 | 2 | 231 | 233 | Dry ISO 1/Fill INJ 1 | 595 | 593 | O | | | O | O | | | | | O | | O | | | | |
| 19 | 60 | 386 | 446 | Paint COL1 on CAR7 | 593 | 393 | | | | | | | | | | | | | | | | O |
| 20 | 60 | 446 | 506 | Paint COL1 on CAR8 | 393 | 193 | | | | | | | | | | | | | | | | O |
| 21 | 58.5 | 506 | 564.5 | Paint COL1 on CAR9 | 193 | 0 | | | | | | | | | | | | | | | | O |
| 22 | 1.5 | 564.5 | 566 | Push Paint1 on CAR9 | 0 | 0 | O | | | O | | | | | | | O | O | | O | | O |
| 23 | 0.5 | 566 | 566.5 | Clean INJ 1 | 0 | 0 | O | O | | O | | | | | | | | | O | | O | O |
| 24 | 1.5 | 566.5 | 568 | Dry INJ 1 | 0 | 0 | O | | | O | | | | | | | | | O | | O | O |
| 25 | 4 | 568 | 572 | Clean CAN 1 | 0 | 1 | O | O | | O | O | | | | | O | O | | O | | O | |
| 26 | 5 | 572 | 577 | Dry CAN 1 | 1 | 1 | O | | | O | O | | | | | O | O | | O | | O | |

FIG - 18

| Canister System 2 | | | | | | | | | | | | | | | | | | | | | | | |
|---|---|---|---|---|---|---|---|---|---|---|---|---|---|---|---|---|---|---|---|---|---|---|---|
| Step # | DUR Time (sec) | Start Time (sec) | Finish Time (sec) | Description | Can 2 Move Start (ml) | Can 2 Move Finish (ml) | pAIR 1054 | pSOL 1058 | pWASH3 1057 | pWASH2 1056 | pDUMP 1026 | pVAC 1049 | pSOL2 1059 | pCOL1 1012 | pCOL2 1012 | pPAINT2 1019 | pCAN-2 1035 | pWASH2-11038 | pWASH2-21039 | pPAINT2-21036 | pW 2 1045 | pTRIG2 1048 |
| 1 | 0.5 | 21 | 21.5 | Vacuum CAN 2 | 0 | 1 | | | | | | O | | | | O | O | | | O | | |
| 2 | 15 | 21.5 | 36.5 | Fill CAN 2 | 1 | 585 | | | | | | | | | O | O | O | | | O | | |
| 3 | 1 | 36.5 | 37.5 | Push ISO 2 | 585 | 595 | | | | | | | O | | | O | O | | | | | |
| 4 | 1.5 | 37.5 | 39 | Clean ISO 2 | 595 | 595 | O | O | | O | O | | | | | O | | O | | | | |
| 5 | 4 | 39 | 43 | Dry ISO 2 | 595 | 593 | O | | | O | O | | | | | O | | O | | | | |
| 6 | 60 | 204 | 264 | Paint COL2 on CAR4 | 593 | 393 | | | | | | | | | | | | | | | | O |
| 7 | 60 | 264 | 324 | Paint COL2 on CAR5 | 393 | 193 | | | | | | | | | | | | | | | | O |
| 8 | 59.5 | 324 | 383.5 | Paint COL2 on CAR6 | 193 | 0 | | | | | | | | | | | | | | | | O |
| 9 | 0.5 | 383.5 | 384 | Push Paint2 on CAR6 | 0 | 0 | O | | | O | | | | | | | O | O | | O | | O |
| 10 | 0.5 | 384 | 384.5 | Clean INJ 2 | 0 | 0 | O | O | | O | | | | | | | | | O | | O | O |
| 11 | 1.5 | 384.5 | 386 | Dry INJ 2 | 0 | 0 | O | | | O | | | | | | | | | O | | O | O |
| 12 | 0.5 | 387 | 387.5 | Vacuum CAN 2 | 0 | 1 | | | | | | O | | | | O | | | | | | |
| 13 | 15 | 387.5 | 402.5 | Fill CAN 2 | 1 | 585 | | | | | | | | | O | O | O | | | | | |
| 14 | 1 | 388.5 | 389.5 | Push ISO 2 | 585 | 595 | | | | | | | O | | | O | O | | | | | |
| 15 | 1.5 | 390 | 391.5 | Clean ISO 2 | 595 | 595 | O | O | | O | O | | | | | O | | O | | | | |
| 16 | 4 | 394 | 398 | Dry ISO 2 | 595 | 593 | O | | | O | O | | | | | O | | O | | | | |
| 17 | 60 | 568 | 628 | Paint COL2 on CAR10 | 593 | 393 | | | | | | | | | | | | | | | | O |
| 18 | 60 | 628 | 688 | Paint COL2 on CAR11 | 393 | 193 | | | | | | | | | | | | | | | | O |
| 19 | 59.5 | 687.5 | 747 | Paint COL2 on CAR12 | 193 | 0 | | | | | | | | | | | | | | | | O |
| 20 | 0.5 | 688 | 688.5 | Push Paint2 on CAR12 | 0 | 0 | O | | | O | | | | | | | O | O | | O | | O |
| 21 | 0.5 | 688.5 | 689 | Clean INJ 2 | 0 | 0 | O | O | | O | | | | | | | | | O | | O | O |
| 22 | 1.5 | 690 | 691.5 | Dry INJ 2 | 0 | 0 | O | | | O | | | | | | | | | O | | O | O |

FIG - 19

| Canister System 1 | | | | | | | | | | | | | | | | | | | | | | |
|---|---|---|---|---|---|---|---|---|---|---|---|---|---|---|---|---|---|---|---|---|---|---|
| Step # | DUR Time (sec) | Start Time (sec) | Finish Time (sec) | Description | Can 1 Move Start (ml) | Can 1 Move Finish (ml) | pCC 1154 | pSOL 1158 | pWASH3 1157 | pWASH1 1155 | pVAC 1149 | pSOL2 1159 | pCOL1 1112 | pCOL2 1112 | pPAINT1 1118 | pCAN-1 1129 | pDUMP1-1 1130 | pDUNP1-2 1131 | pIW1 1143 | pPE1 1145 | pTRIG1 1147 |
| 1 | 0.5 | 0 | 0.5 | Vacuum CAN 1 | 1 | 1 | | | | | O | | | | O | O | | | | O | |
| 2 | 15 | 0.5 | 15.5 | Fill CAN 1 | 1 | 585 | | | | | | | O | | O | O | | | | O | |
| 3 | 1 | 15.5 | 16.5 | Push ISO 1 | 585 | 595 | | | | | | O | | | O | O | | | | | |
| 4 | 1.5 | 16.5 | 18 | Clean ISO 1 | 595 | 595 | O | O | | O | | | | | O | | O | | | | |
| 5 | 4 | 18 | 22 | Dry ISO 1 | 595 | 593 | O | | | O | | | | | O | | O | | | | |
| 6 | 60 | 22 | 82 | Paint COL1 on CAR1 | 593 | 393 | | | | | | | | | | | | | | O | O |
| 7 | 60 | 82 | 142 | Paint COL1 on CAR2 | 393 | 193 | | | | | | | | | | | | | | O | O |
| 8 | 58.5 | 142 | 200.5 | Paint COL1 on CAR3 | 193 | 0 | | | | | | | | | | | | | | O | O |
| 9 | 1.5 | 200.5 | 202 | Push Paint1 on CAR3 | 0 | 0 | O | | | O | | | | | | O | | | | O | O |
| 10 | 0.5 | 202 | 202.5 | Clean INJ 1 | 0 | 0 | O | O | | O | | | | | | | | | O | | O |
| 11 | 1.5 | 202.5 | 204 | Dry INJ 1 | 0 | 0 | O | | | O | | | | | | | | | O | | O |
| 12 | 4 | 204 | 208 | Clean CAN 1 | 0 | 1 | O | O | | O | | | | | O | O | | O | O | O | |
| 13 | 5 | 208 | 213 | Dry CAN 1 | 1 | 1 | O | | | O | | | | | O | O | | | O | O | |
| 14 | 0.5 | 213 | 213.5 | Vacuum CAN 1 | 1 | 1 | | | | | O | | | | O | O | | | | O | |
| 15 | 15 | 213.5 | 228.5 | Fill CAN 1 | 1 | 585 | | | | | | | | O | O | O | | | | O | |
| 16 | 1 | 228.5 | 229.5 | Push ISO 1 | 585 | 595 | | | | | | O | | | O | O | | | | | |
| 17 | 1.5 | 229.5 | 231 | Clean ISO 1 | 595 | 595 | O | O | | O | | | | | O | | O | | | | |
| 18 | 2 | 231 | 233 | Dry ISO 1/Fill INJ 1 | 595 | 593 | O | | | O | | | | | O | | O | | | | |
| 19 | 60 | 386 | 446 | Paint COL1 on CAR7 | 593 | 393 | | | | | | | | | | | | | | O | O |
| 20 | 60 | 446 | 506 | Paint COL1 on CAR8 | 393 | 193 | | | | | | | | | | | | | | O | O |
| 21 | 58.5 | 506 | 564.5 | Paint COL1 on CAR9 | 193 | 0 | | | | | | | | | | | | | | O | O |
| 22 | 1.5 | 564.5 | 566 | Push Paint1 on CAR9 | 0 | 0 | O | | | O | | | | | | O | | | | O | O |
| 23 | 0.5 | 566 | 566.5 | Clean INJ 1 | 0 | 0 | O | O | | O | | | | | | | | | O | | O |
| 24 | 1.5 | 566.5 | 568 | Dry INJ 1 | 0 | 0 | O | | | O | | | | | | | | | O | | O |
| 25 | 4 | 568 | 572 | Clean CAN 1 | 0 | 1 | O | O | | O | | | | | O | O | | O | O | O | |
| 26 | 5 | 572 | 577 | Dry CAN 1 | 1 | 1 | O | | | O | | | | | O | O | | | O | O | |

FIG - 21

| Canister System 2 | | | | | | | | | | | | | | | | | | | | | | |
|---|---|---|---|---|---|---|---|---|---|---|---|---|---|---|---|---|---|---|---|---|---|---|
| Step # | DUR Time (sec) | Start Time (sec) | Finish Time (sec) | Description | Can 2 Move Start (ml) | Can 2 Move Finish (ml) | pCC 1154 | pSOL 1158 | pWASH3 1157 | pWASH2 1156 | pVAC 1130 | pSOL2 1149 | pCOL1 1112 | pCOL2 1112 | pPAINT2 1119 | pCAN-2 1135 | pDUMP2-1 1136 | pDUMP2-2 1137 | pIW2 1144 | pPE 2 1146 | pTRIG2 1148 |
| 1 | 0.5 | 21 | 21.5 | Vacuum CAN 2 | 0 | 1 | | | | | O | | | | O | O | | | | O | |
| 2 | 15 | 21.5 | 36.5 | Fill CAN 2 | 1 | 585 | | | | | | | O | | O | O | | | | O | |
| 3 | 1 | 36.5 | 37.5 | Push ISO 2 | 585 | 595 | | | | | | O | | | O | O | | | | | |
| 4 | 1.5 | 37.5 | 39 | Clean ISO 2 | 595 | 595 | O | O | | O | | | | | O | | O | | | | |
| 5 | 4 | 39 | 43 | Dry ISO 2 | 595 | 593 | O | | | O | | | | | O | | O | | | | |
| 6 | 60 | 206 | 266 | Paint COL2 on CAR4 | 593 | 393 | | | | | | | | | | | | | | O | O |
| 7 | 60 | 266 | 326 | Paint COL2 on CAR5 | 393 | 193 | | | | | | | | | | | | | | O | O |
| 8 | 60 | 326 | 386 | Paint COL2 on CAR6 | 193 | 0 | | | | | | | | | | | | | | O | O |
| 9 | 2 | 386 | 388 | Push Paint2 on CAR6 | 0 | 0 | O | | | O | | | | | | O | | | | O | O |
| 10 | 0.5 | 388 | 388.5 | Clean INJ 2 | 0 | 0 | O | O | | O | | | | | | | | | O | | O |
| 11 | 1.5 | 388.5 | 390 | Dry INJ 2 | 0 | 0 | O | | | O | | | | | | | | | O | | O |
| 12 | 0.5 | 391 | 391.5 | Vacuum CAN 2 | 0 | 1 | | | | | O | | | | O | | | | | O | |
| 13 | 15 | 391.5 | 406.5 | Fill CAN 2 | 1 | 585 | | | | | | | O | | O | O | | | | O | |
| 14 | 1 | 392.5 | 393.5 | Push ISO 2 | 585 | 595 | | | | | | O | | | O | O | | | | | |
| 15 | 1.5 | 394 | 395.5 | Clean ISO 2 | 595 | 595 | O | O | | O | | | | | O | | O | | | | |
| 16 | 4 | 398 | 402 | Dry ISO 2 | 595 | 593 | O | | | O | | | | | O | | O | | | | |
| 17 | 60 | 573 | 633 | Paint COL2 on CAR10 | 593 | 393 | | | | | | | | | | | | | | O | O |
| 18 | 60 | 633 | 693 | Paint COL2 on CAR11 | 393 | 193 | | | | | | | | | | | | | | O | O |
| 19 | 60 | 693 | 753 | Paint COL2 on CAR12 | 193 | 0 | | | | | | | | | | | | | | O | O |
| 20 | 2 | 695 | 697 | Push Paint2 on CAR12 | 0 | 0 | O | | | O | | | | | | O | | | | O | O |
| 21 | 0.5 | 695.5 | 696 | Clean INJ 2 | 0 | 0 | O | O | | O | | | | | | | | | O | | O |
| 22 | 1.5 | 697 | 698.5 | Dry INJ 2 | 0 | 0 | O | | | O | | | | | | | | | O | | O |

FIG - 22

ROBOTIC PAINTING SYSTEM AND METHOD

CROSS-REFERENCE TO RELATED APPLICATION

This application is a continuation-in-part of the U.S. patent application Ser. No. 12/187,663 filed on Aug. 7, 2008, now U.S. Pat. No. 8,051,796, issued Nov. 8, 2011, which is a continuation-in-part of U.S. patent application Ser. No. 11/872,372 filed Oct. 15, 2007, now U.S. Pat. No. 7,638,000 issued Dec. 29, 2009, which is a continuation of U.S. patent application Ser. No. 10/691,939 filed Oct. 23, 2003, now U.S. Pat. No. 7,399,363 issued Jul. 15, 2008, each of which is incorporated herein by reference in its entirety.

This application claims the benefit of U.S. provisional patent application Ser. No. 61/167,614 filed on Apr. 8, 2009, hereby incorporated herein by reference in its entirety.

FIELD OF THE INVENTION

The present invention relates to a robotic painting system for applying electrically conductive paint to an external surface of an automotive vehicle body, and more particularly to improvements in the electrostatic application of conductive coatings.

BACKGROUND OF THE INVENTION

Prior art paint booths are well known. A typical prior art paint booth for painting an exterior surface of a vehicle body in a continuous conveyance and stop station system includes an enclosure housing and a plurality of paint applicators. In one configuration, the applicators are mounted on an inverted U-shaped support structure that includes two vertical supports, one on either side of the path of travel of the vehicle body, and connected at a top thereof by a horizontal support structure. The support structure facilitates painting of a top surface of the vehicle body, and the horizontal beam can be fixed or have an additional degree of freedom to move along the top surface of the vehicle body being painted. Another painting device is used in the same painting zone to paint sides of the vehicle body, and generally is not capable of moving laterally along the length of the vehicle body. Disadvantages of this type of painting apparatus include lack of flexibility to provide optimized standoff distance between the vehicle body surface and the applicator, and inefficient use of the allotted painting cycle time. The paint applicators of the painting devices adapted to paint the top surface of the vehicle are mounted on a common beam. Therefore, the distance between each paint applicator and the surface to be painted varies with the contours of the vehicle body. The paint applicators of the painting devices adapted to paint the sides of the vehicle include applicators that do not move transverse to the path of the vehicle body. Accordingly, the paint applicators can only paint a portion of the vehicle body that is in front of the applicator, leaving a substantial portion of the available cycle time unused.

A more recent alternative to the support structure is a floor-mounted robot disposed along the sides of the paint booth. The robots include spray guns or rotary applicators (bell machines) mounted thereon for directing atomized paint toward the vehicle body. While rotary applicators have advantages over spray guns, there are some associated disadvantages. The prior art floor mounted robot, especially robots having rotary applicators, are costly and limit visual access to the spray booth. The bell machines require more bells for the same throughput due to limited orientation capability. The additional bells use more paint per vehicle due to the waste generated by each bell during a paint color changing operation. Prior art floor mounted robots also require significant booth modification when installed in existing paint booths, thereby increasing installation time and cost, and requiring more floor space within the paint booth. The rail axis of floor mounted robot requires doors at both ends of the paint booth. The waist axis of the floor mounted robot requires an additional safety zone at the ends of the spray booth, and the rail cabinets of the floor mounted robot encroach into aisle space. The floor mounted robot also requires frequent cleaning due to a down draft of paint overspray causing paint accumulation on the robot arm and base, which results in higher maintenance and cleaning costs.

Due to the conductivity of the waterborne paint, it is necessary to electrically isolate the grounded bulk paint supply system from a charged local dispensing canister and spray application system. In the prior art, the bell applicator, canister, canister drive, electrostatic cascade, and docking interface were all integrated into a single unit mounted on the robot wrist as shown in U.S. Pat. Nos. 5,293,911 and 5,367,944. Such an applicator has the following shortcomings: 1) the applicator is heavy, expensive, and subject to damage via collision with objects in the painting booth; 2) the applicator docking with a docking station must occur in a fixed booth position which limits process flexibility; 3) the docking process takes cycle time as the robot must travel to and from the docked position, and the canister filling cannot start until the applicator reaches the docked position; and 4) the docking hardware is expensive and unique to waterborne systems.

To prepare the robot for a painting operation, the canister must be filled with paint. To fill the canister with paint, a piston slidably disposed in the canister is drawn away from the cylinder bottom and an applicator valve is opened, thereby introducing a small amount of air into the canister. The paint is then caused to flow from a selected color valve, through an isolation line, and into the canister. As the initial volume of the canister is filled through a trigger passage of the applicator, air is pushed out of the system through the applicator until the paint reaches a restriction in the trigger passage. The restriction causes an increase in the fluid pressure in the canister due to the viscosity difference between the paint and the air being displaced by the paint. The pressure increase causes a torque applied by a drive motor to increase, which can be sensed and used to adjust the rate of filling of the canister. Once the canister and applicator are filled, air in the canister is removed. To remove the air from the canister, an amount of air and paint is expelled from the canister through the applicator until the air is removed, thereby wasting the amount of paint expelled. Another filling operation known as the pressure based fill through injector tip mode of filling the canister utilizes the torque feedback to determine when the paint will fill the canister. A single torque feedback value is typically used for the filling operation of each of the colors. However, because the viscosities and bulk pressure of the paints vary from color to color, time based filling operations may lead to wasted paint (time too long) or an improperly filled system (time too short).

The piston may be utilized to optimize the canister fill operation time. First, if the fill rate of paint into the canister is known or can be automatically measured, the rate at which the canister piston mechanism is drawn away from the canister bottom may be adjusted to minimize the pressure drop of the incoming paint, and decrease the fill time. The fill rate may be sensed by measuring either servo error (positive or negative) or motor torque feedback applied to the piston. Second, the piston may be drawn away from the canister bottom at a rate known to be slightly below the system fill rate. However, as the paint rapidly fills the canister, air may become entrapped in the canister and mixed with the paint.

The grounded bulk paint supply must be isolated from charged system components to militate against voltage leakage and electrostatic erosion. A method to isolate the bulk paint supply system from the charged paint dispensing canister is to clean and dry the paint transfer line between the supply system and the canister. In an automotive-type painting system (rapid color changing on a continuous conveyance type system), a dump line is typically connected to and in fluid communication with the bell applicator or other portion of the system downstream from the canister. When cleaning the interior of the canister, the piston is drawn away from the canister bottom. The piston is cycled in and out of the canister as a solvent and air mixture is introduced into the canister to facilitate effective cleaning of the area between the piston and the bottom of the canister. Simultaneous to the cleaning of the canister with a solvent and air mixture, a paint line from the canister to the applicator is backflushed. As the piston cycles and is caused to slidably enter the canister toward the applicator, the solvent and air mixture is forced out of the canister and through the dump line. After canister cleaning, the system is ready to be filled with a different color of paint.

This method of cleaning the robot has numerous shortcomings, including: 1) a time to clean and dry the line and provide high voltage isolation exceeds the allotted dwell time between the vehicle bodies being painted; 2) paint residue remaining on the walls of the transfer line, the dump line, or the interior of the canister may lead to a high voltage leakage causing electrostatic erosion that may burn holes in the transfer line, the dispensing system, the supply line to the applicator, or the waste collection lines; 3) an amount of waste that is left in the paint transfer line is excessive when compared to other means of isolation; and 4) because the solvent and air mixture containing paint residues is caused to flow through the dump line downstream from the solvent and air mixture input, paint residue may remain at the connection between the dump line and the canister.

As environmentally friendly waterborne coatings become more popular, customers are demanding reductions in the time and material waste associated with preparing the automatic system for electrostatic painting. The paint fluid delivery system is a key component in the application of waterborne coatings. A direct charge waterborne fluid delivery system is required to accomplish the following: clean the application system and prepare it for loading the next coating material; load the desired coating material from the bulk supply system (paint circulation system); electrically isolate the loaded quantity of paint from the grounded bulk supply system; and precisely control the rate of flow (metered dispense) from the delivery system to the coating applicator.

For example, when painting car bodies in automotive final assembly paint shops it is common to change colors often. Typical color batch size for body painting is a group of 1-5 cars. Color change time ranges between 6-15 seconds or 10-25% of the available cycle time per car. The amount of paint wasted per robot in the color change process is typically between 12-50 ml or 5-10% of the paint used by a particular robot. Low color change and refill waste are important design factors for automotive final color change systems. Refill and color change time are also important.

As a further example, when painting plastic add-on parts such as fascia, body side claddings, or instrument panels in automotive component painting lines, batch sizes are larger and color changing is less frequent; however, the cycle time per part is also less. Parts are painted in batches of 10 to 200 parts and it is desired to paint parts continuously or without dwell time between parts. In this type of painting system it is typical to leave a gap between batches of parts for color change.

Simplicity of design is important to the reliability of the system. For example, key fluid delivery design elements of a direct charge coating system include:

1. cycle time to refill the same color;
2. paint and cleaning solvent waste when refilling the same color;
3. cycle time to change to a new color;
4. paint and cleaning solvent waste when changing to a new color;
5. flow rate demand on paint circulation system;
6. equipment cost; and
7. system complexity and reliability;

The industry currently lacks a cost effective and reliable direct charge fluid delivery system that is capable of providing the benefits of fast color change and fast refill needed for automotive body and component painting systems.

Today's voltage block systems are mainly single canister systems. The single reservoir system with single voltage block is simple, reliable, and wastes little paint, but the color change and refill time is excessive. The single canister must be filled quickly, which also puts high demand on the paint circulation system. Color change and refill can be executed in 8 to 15 seconds when 0-4 seconds is desired.

Parallel fluid circuits for solvent based paints, also called dual purge systems, have been used in the past to reduce color change time. The parallel systems generally have multiple flow control and flushing systems. While one side is painting the other side is getting the next color ready. The parallel circuits are designed for solvent based paints having significantly lower conductivity and cannot be used for waterborne applications. The painting side is charged and therefore requires the next color loading side to be isolated from the painting side.

Most of the prior art systems are extremely complex. Having many valve and voltage blocking devices and moving parts in contact with paint, these systems are difficult to maintain and operate.

It would be desirable to provide a robotic painting system and a method of operating the painting system, wherein a color change time and a paint waste are minimized and a cleaning operation of the system is optimized.

SUMMARY OF THE INVENTION

Concordant and consistent with the present invention, a robotic painting system and a method of operating the painting system, wherein a color change time and a paint waste are minimized and a cleaning operation of the system is optimized, has surprisingly been discovered.

In one embodiment, a painting system comprises: an outer arm moveable within a spray booth; an at least two-axis wrist with one end attached to the outer arm; a paint applicator attached to an other end of the wrist; a first paint metering device mounted on the robot and including an inlet and an outlet, wherein the outlet is in fluid communication with the paint applicator via a first paint line; a second paint metering device mounted on the robot and including an inlet and an outlet, wherein the outlet is in fluid communication with the paint applicator via a second paint line; a color changer mounted on the robot and in fluid communication with each of inlets of the paint metering devices to fill at least one of the paint metering devices with a desired amount of paint, wherein each of the paint metering devices is electrostatically isolated from the color changer and wherein a vacuum is subjected to at least one of the internal passages of the paint applicator, the first paint metering device, the second paint metering device, the color changer, and related fluid connections to remove an amount of air prior to causing paint to flow therethrough.

In another embodiment, a painting system comprises: a robot arm moveable within a spray booth; a paint applicator coupled to the robot arm and including a first injector path and a second injector path in fluid communication with an atomizing device of the paint applicator, wherein each of the injector paths is independent and insulated from each other and each of the injector paths can be electrically isolated from each other; a paint metering device mounted on the robot arm and including an inlet and an outlet, wherein the outlet is in fluid communication with at least one of the injector paths of the paint applicator and the inlet is in fluid communication with a paint supply.

Methods of operating a robotic painting system are also disclosed.

One method comprises the steps of: providing a paint applicator including a first injector path and a second injector path in fluid communication with an atomizing device of the paint applicator, wherein each of the injector paths is independent and insulated from each other and each of the injector paths can be electrically isolated from each other; providing a paint metering device including an inlet and an outlet, wherein the outlet is in fluid communication with at least one of the injector paths of the paint applicator and the inlet is in fluid communication with a paint supply; filling the paint metering device with the desired amount of paint by causing the paint to flow from the paint supply to the paint metering device; and performing a painting operation by dispensing the paint from the paint metering device through one of the injector paths.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIGS. 9-10 are valve charts showing valve configurations for a plurality of operational procedures executed by the painting system of FIG. 8;

FIGS. 12-13 are valve charts showing valve configurations for a plurality of operational procedures executed by the painting system of FIG. 11;

FIGS. 15-16 are valve charts showing valve configurations for a plurality of operational procedures executed by the painting system of FIG. 14;

FIGS. 18-19 are valve charts showing valve configurations for a plurality of operational procedures executed by the painting system of FIG. 17;

FIGS. 21-22 are valve charts showing valve configurations for a plurality of operational procedures executed by the painting system of FIG. 20.

DETAILED DESCRIPTION OF THE EMBODIMENTS

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
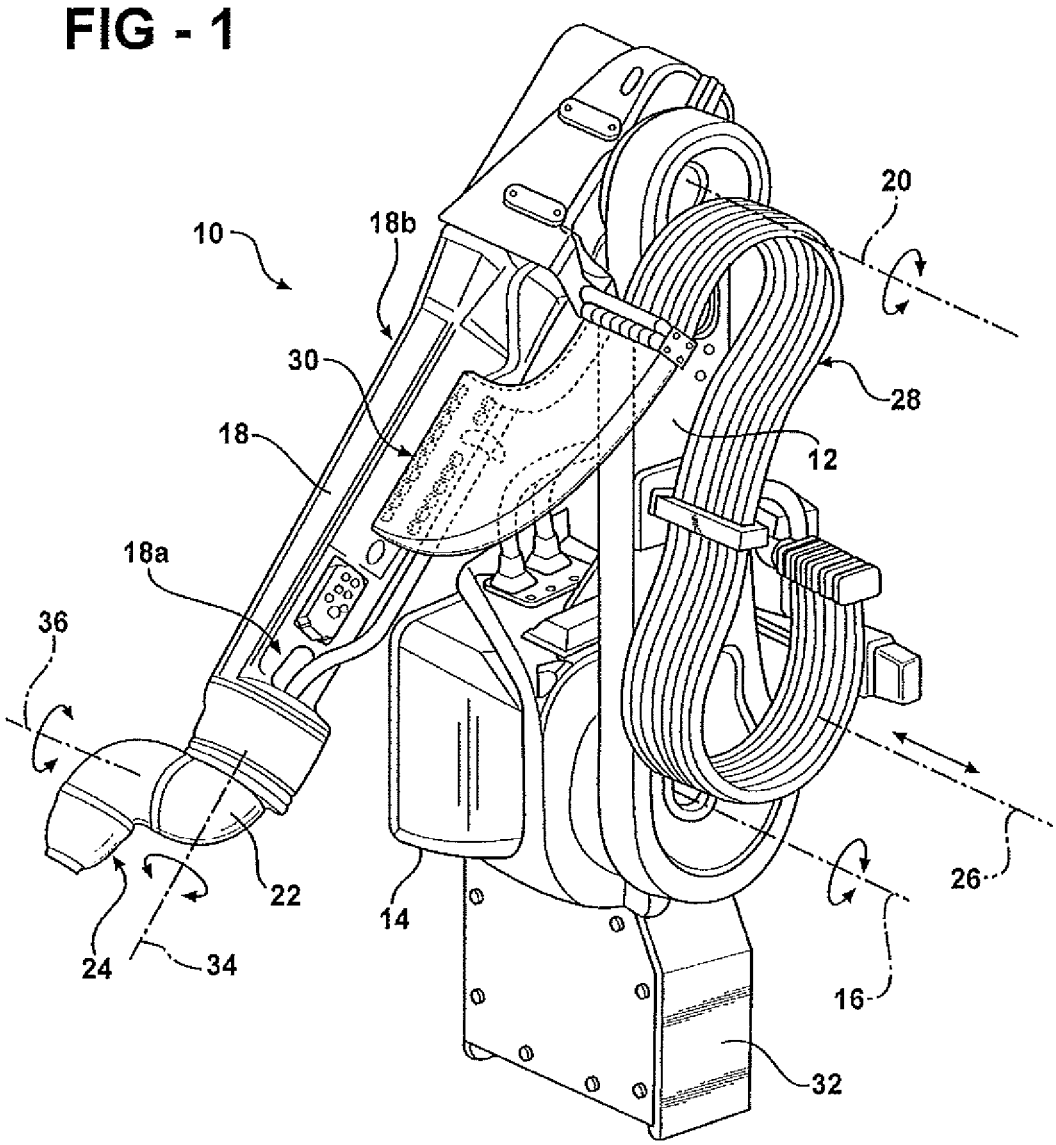
FIG. 1 is a perspective view of a robotic painting system according to an embodiment of the invention.

FIG. 1 illustrates a robot painting system 10 according an embodiment of the invention. The painting system 10 includes an inner arm 12 and an outer arm 18. The painting system 10 provides four axes of motion 16, 20, 34, 36 relative to a base 14 for respective pivotal movement of the inner arm 12, the outer arm 18, a wrist 22, and an applicator 24. Mounting the robot base 14 to a frame system may provide a fifth axis of motion 26 longitudinally along an axis of the frame system (not shown). It is understood that any number of the painting system 10 may cooperate with or be mounted to the frame system to facilitate optimal painting of a vehicle.

The inner arm 12 is mounted to the robot base 14 for rotation about the shoulder axis 16, and includes a plurality of paint lines 28. The paint lines 28 are connected to a first side of the inner arm 12 and provide fluid communication between a bulk supply of paint (not shown) and a color changer 30 of the outer arm 18. The robot base 14 includes a process control enclosure 32 which includes pneumatic valves and control components (not shown) adapted to adjust and move the painting system 10.

The outer arm 18 includes the first side 18*a*, a second side 18*b*, and the wrist 22. A first end of the outer arm 18 is mounted to a second end of the inner arm 12 for rotation about the elbow axis 20. The outer arm 18 is formed from a non-conductive material having suitable structural strength and is substantially impervious to the corrosive properties of solvents used in the painting process. An example of such a material is Lauramid A material. "Lauramid" is a registered trademark of Albert Handtmann ELTEKA Verwaltungs-GmbH of Biberach, Germany. Lauramid A material is a castable polyamide Nylon 12G material that also provides for electrostatic isolation, cleanliness, cleaning capability, and weight advantages.

Figure 2:
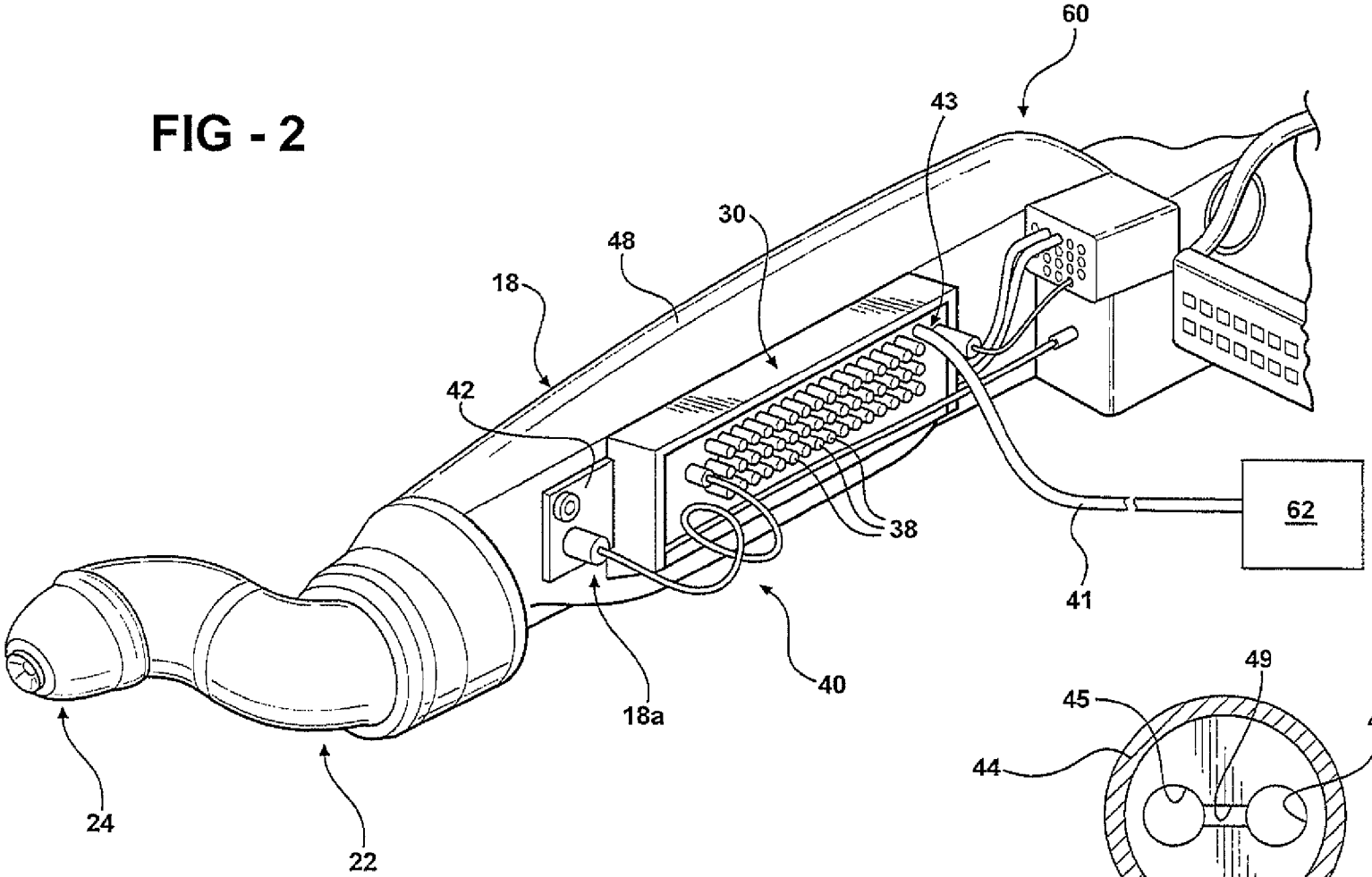
FIG. 2 is a perspective view of a first side of an outer arm of the painting system of FIG. 1.

As shown in FIG. 2, the first side 18*a* of the outer arm 18 includes the color changer 30, an isolation line 40 that is electrostatically isolated from the electrically charged components of the painting system 10, a dump line 41, and a canister manifold 42. The color changer 30 includes a plurality of electrically grounded color valves 38. Each of the color valves 38 is disposed between a desired one of the paint lines 28 shown in FIG. 1 and the color changer 30. The isolation line 40 is connected to, and provides fluid communication between, an outlet of the color changer 30 and the canister manifold 42. The isolation line 40 is typically formed from fluorinated ethylene propylene (FEP) material. The dump line 41 provides fluid communication between an outlet 43 of the color changer 30 and a disposal system 62. The dump line 41 is connected to the color changer 30 upstream of the isolation line 40 and the color valves 38.

Figure 4:
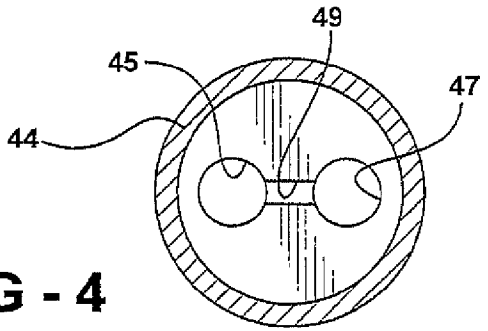
FIG. 4 is a cross-sectional top plan view of the canister of FIG. 3.
Figure 3:
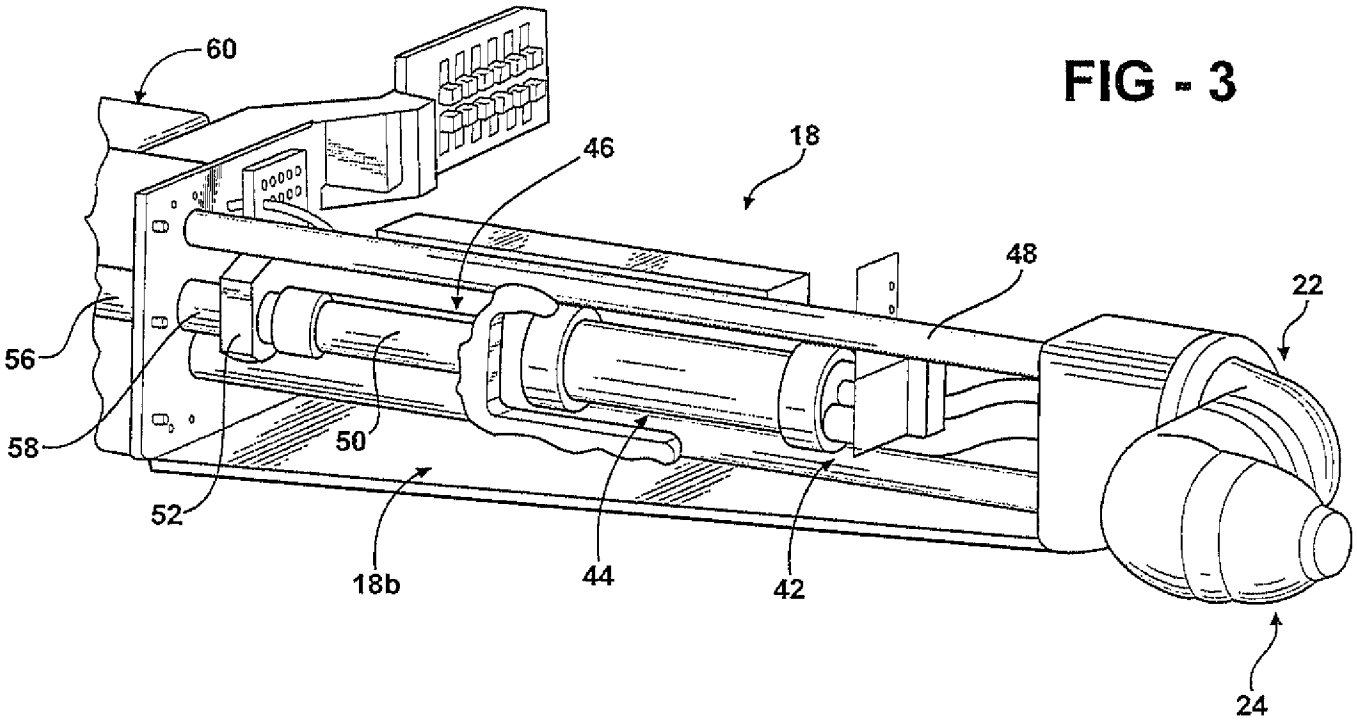
FIG. 3 is a perspective view of a second side of the outer arm of the painting system of FIG. 1.

FIG. 3 illustrates the second side 18*b* of the outer arm 18. The second side 18*b* includes a canister 44 and a drive assembly. The canister 44 is in fluid communication with the canister manifold 42 and is electrically charged but electrostatically isolated from the grounded color valves 38 on the first side 18*a* of the outer arm 18 by an insulated housing 48. A first end of the canister 44 is disposed adjacent the wrist 22. As shown in FIG. 4 the first end of the canister 44 includes an inlet 45 in fluid communication with the canister manifold 42, an outlet 47 in fluid communication with the applicator 24, and a channel 49 formed therebetween in fluid communication with the inlet 45 and the outlet 47 of the canister 44. The channel 49 facilitates the flow of paint from the inlet 45 of the canister to the outlet 47 of the canister 44 and into the applicator 24 without withdrawing the piston 50 and introducing air to the canister 44.

Figure 5:
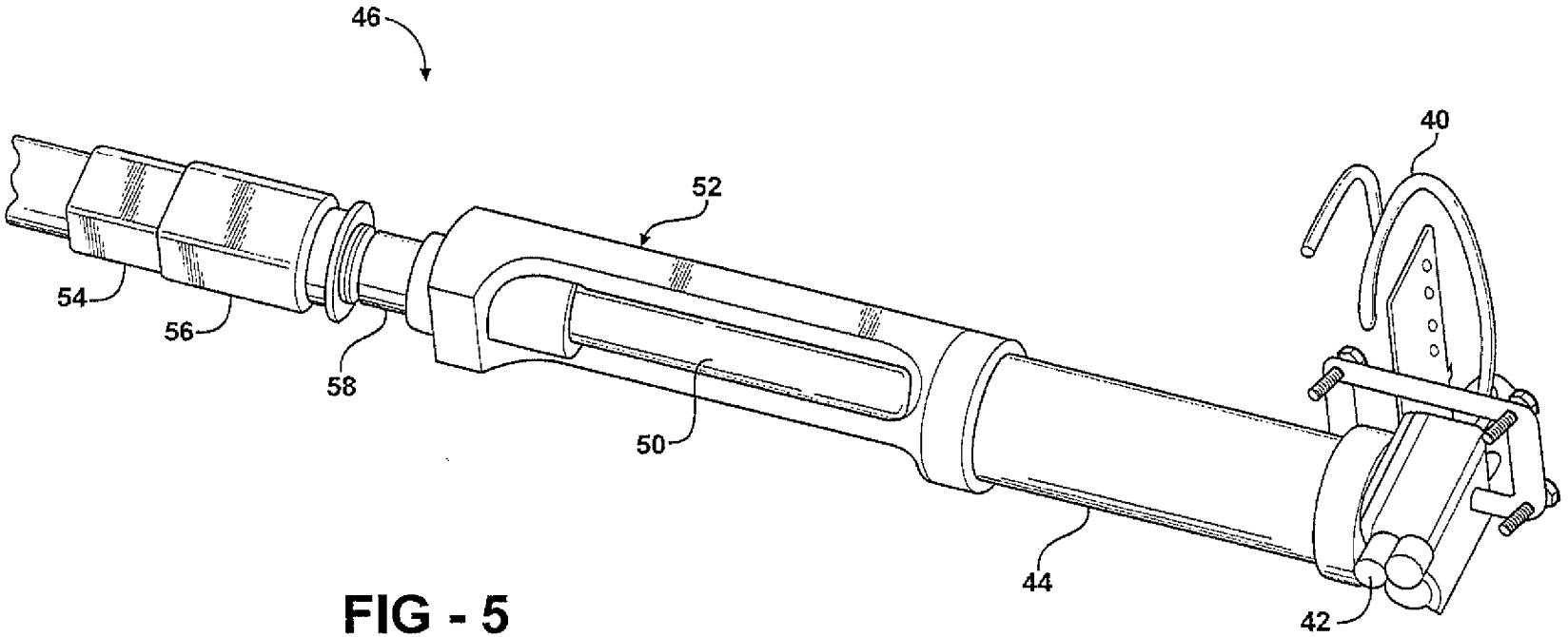
FIG. 5 is a perspective view of the canister and the drive assembly of FIG. 3.

The drive assembly 46 includes a piston ram 50 with a piston (not shown) slidably disposed in the canister 44 and operably connected to a drive bracket 52. As shown in FIG. 5, a drive motor 54 provides rotational motion to the piston ram 50 through a reducer 56 and a coupling 58. The piston ram 50 is a ball screw type drive utilized to dispense paint to the applicator 24 during a vehicle painting operation. A piston (not shown) of the piston ram 50 is moved longitudinally within the canister 44. Because the canister drive motor 54 and the reducer 56 are disposed in an elbow 60 connecting the outer arm 18 to the inner arm 12, the drive motor 54 is spaced from a high voltage cascade (not shown) adapted to electrostatically charge the paint in the canister 44.

As shown in FIG. 3, the wrist 22 is disposed on a second end of the outer arm 18 and includes the applicator 24 extending laterally outwardly therefrom. The applicator 24 extends in an axis parallel to the longitudinal axis of the outer arm 18. In the embodiment shown, the applicator 24 is a rotary bell applicator. The wrist 22 causes a rotation of the applicator 24 about the rotating axis 34 substantially parallel to a longitudinal axis of the outer arm 18, as shown in FIG. 1. The wrist 22 also facilitates a pivoting of the applicator 24 about the tilting axis 36 substantially perpendicular to the rotating axis 34. The wrist 22 and the applicator 24 are typically formed from a non-conductive material having suitable structural strength and impervious to the corrosive properties of solvents used in the painting process. An example of such a material is Lauramid A material. "Lauramid" is a registered trademark of Albert Handtmann ELTEKA Verwaltungs-GmbH of Biberach, Germany. Lauramid A material is a castable polyamide Nylon 12G material that also provides for electrostatic isolation, cleanliness, cleaning capability, and weight advantages.

To fill the painting system 10 in anticipation of the painting operation, a vacuum is generated in the isolation line 40 using the piston ram 50. An inlet valve (not shown) in communication with the canister 44 and the canister manifold 42 is opened. An outlet valve (not shown) in communication with the canister 44 and the applicator 24 is also closed. With the inlet valve opened and the outlet valve closed, the piston of the ram 50 is then drawn away from the first end of the canister 44 to generate the vacuum. The inlet valve is then closed and the outlet valve opened, thereby causing the piston of the ram 50 to be drawn towards the applicator 24 forcing air out of the canister 44 through the applicator 24. With air removed from the canister 44 the inlet is opened, paint is caused to flow from the bulk supply of paint through a desired paint line 28, through a desired color valve 38, through the color changer 30, through the isolation line 40, through the canister manifold 42, and into the canister 44. As the paint is caused to flow into the canister 44 through the inlet 45, paint flows through the channel 49 and to the outlet 47 to simultaneously fill the applicator 24 and the canister 44, without introducing air into the canister 44. Filling the canister 44 with paint after air is removed from the canister 44, and without introducing air back into the canister 44, eliminates the need for a bleed operation adapted to remove air from the painting system 10, thereby minimizing paint waste. A solvent may be caused to flow through the color changer and the isolation line 40 to apply pressure on the paint flowing into the canister 44. The volumetric flow of solvent is controlled so that the solvent does not enter the canister 44. The level of intermixing of the paint and the solvent varies based on the viscosity of the paint, the viscosity of the solvent, the diameter of the isolation line 40 and other system lines, and the fill velocity of the paint and the solvent. To militate against an intermixing of the solvent and the paint, the viscosity of the solvent relative to the paint may be maximized. The benefit of applying a pressure on the paint using the solvent is that the isolation line and system lines are cleaned while the paint fills the canister 44, thereby minimizing the time between the filling operation and a cleaning operation. Additionally, as the viscosity of the solvent is increased and the intermixing is decreased, an amount of paint purged from the system during a change in paint color is minimized.

As the pressure increases in the canister 44 the paint exerts a force on the piston of the 50 and causes the piston to be moved away from the applicator 24. The pressure on the piston is sensed by the drive motor 54 as a torque feedback. Once a desired torque feedback indicating a filled canister 44 is reached, the inlet valve is closed. The desired torque feedback may be determined by measuring a change in the pressure within the canister 44. As the paint enters the canister 44, pressure gradually builds in the canister 44. When the paint has filled the available space, the rate of pressure building within the system increases. By observing the rate of change of the pressure build, the operator may determine when the canister 44 is filled with a desired amount of paint regardless of the viscosity or bulk supply pressure of the paint, thereby militating against time based filling operations and set torque feedback limits that lead to wasted paint from an extended filling operation or an improperly filled system from a shortened filling operation.

Measurement of the torque feedback allows an operator to determine both a negative torque (vacuum) generated during a cleaning operation and a positive torque (pressure) generated during a filling operation to ensure fill and cleaning operations proceed as desired. Furthermore, measurement of the torque feedback facilitates a diagnostic check of the painting system 10 for leaks. A variation in positive torque during filling operations of the painting system 10 over time, and a variation in negative torque during the cleaning operation of the painting system 10 over time, may indicate a leak in the painting system 10. If a leak is detected or the torque feedback is outside a desired value, the operator of the painting system 10 may initiate one of the following: a cleaning operation followed by a fill operation to obtain the desired torque feedback; a diagnostic test to generate information to the operator regarding malfunctioning system components; and a switch from the vacuum fill operation to a pressure fill through an injector fill operation as known in the art.

After the filling operation, the canister 44 is electrostatically charged and the painting operation is performed as known in the art. To clean the canister 44 of the painting system 10 after the painting operation, a solvent and air mixture is caused to flow through the canister manifold 42 and into the canister 44. The solvent and air mixture is then caused to backflow from the canister 44, through the isolation line 40, through the dump line 41, and to the disposal system 62. Accordingly, the dump line 41 is not in direct contact with the electrically charged canister 44. Further, the dump line 41 is disposed downstream from the canister 44 and the isolation line 40. Because the dump line 41 is isolated from the charged canister 44, electrostatic erosion caused by paint residue on the inner walls of the dump line 41 is not a primary concern.

Figure 6:
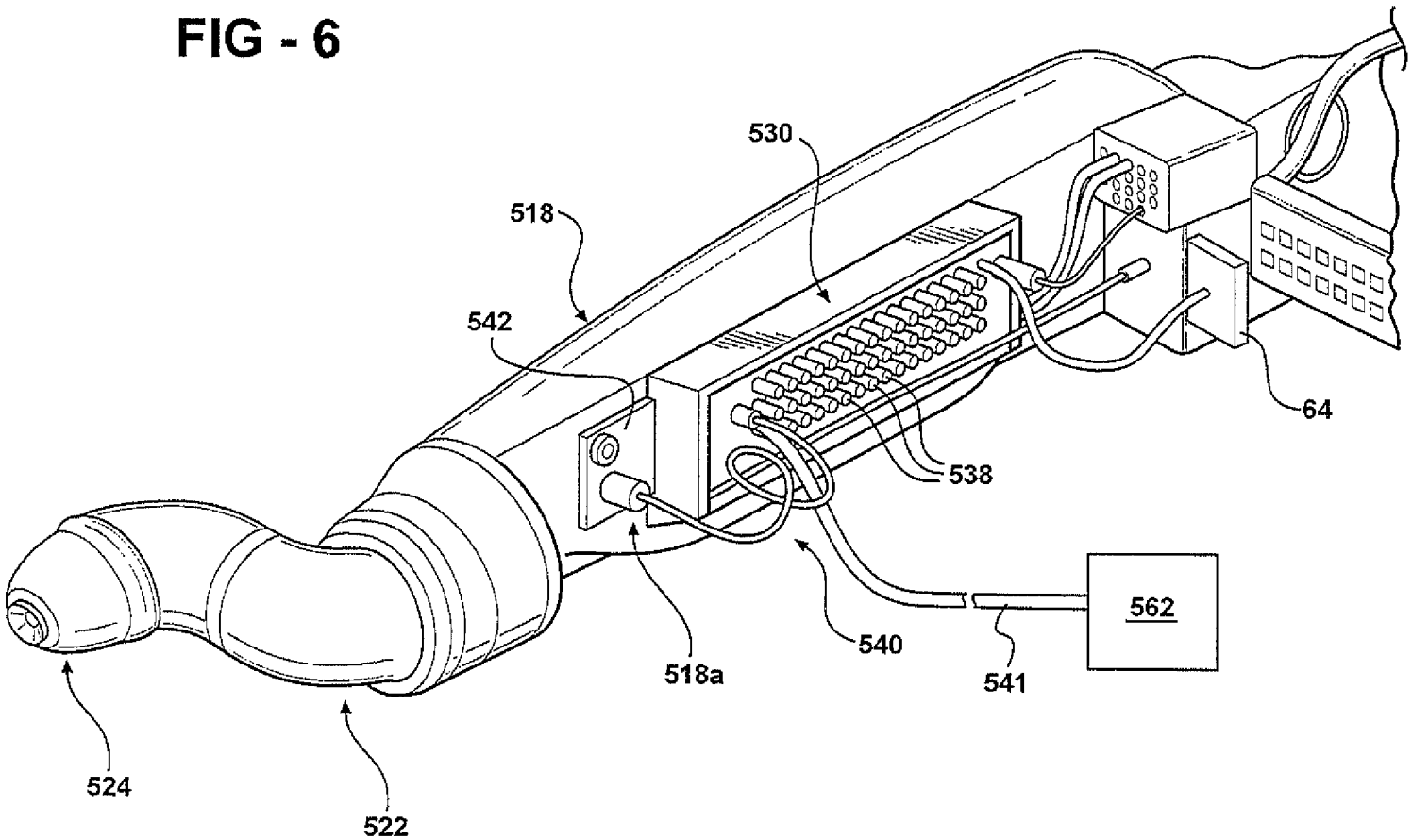
FIG. 6 is a perspective view of a first side of an outer arm of a painting system according to another embodiment of the invention.

FIG. 6 shows a first side 518*a* of an outer arm 518 of a painting system according to another embodiment of the invention. The embodiment of FIG. 6 is similar to the painting system 10 and the outer arm of FIGS. 1 and 2 except as described below. Like the structure repeated from FIGS. 1 and 2 includes the same reference numerals preceded by the digit "5".

The outer arm 518 includes a color changer 530, an isolation line 540 electrostatically isolated from the electrically charged components of the painting system, a dump line 541, a canister manifold 542, and a means for generating a vacuum 64. The color changer 530 includes a plurality of electrically grounded color valves 538 disposed on an exterior side surface of the first side 518*a* of the outer arm 518. Each of the color valves 538 is in fluid communication with an associated paint line. The isolation line 540 is connected to, and provides fluid communication between, an outlet of the color changer 530 and the canister manifold 542. The isolation line 540 is typically formed from fluorinated ethylene propylene (FEP). The dump line 541 provides fluid communication between the isolation line 540 and a disposal system 562. The dump line 541 is connected to the isolation line 540 upstream of a canister (not shown) disposed on a second side of the outer arm 518. A valve (not shown) disposed between the isolation line 540 and the dump line 541 facilitates the selective flow of fluid from the isolation line 540 and through the dump line 541. The canister manifold 542 is in fluid communication with the canister on the second side of the outer arm 518. In the embodiment shown, the means for generating a vacuum 64 is a venturi-type vacuum generator. However, the means for generating a vacuum 64 may be any conventional device adapted to generate a vacuum. The means for generating a vacuum 64 is connected to the first side 518*a* of the outer arm 518 adjacent to the color changer 530. The means for generating a vacuum is in fluid communication with the interior of the canister. It is understood that the means for generating a vacuum 64 may be disposed on another portion of the painting system or remotely disposed, as desired.

To fill the painting system in anticipation of a painting operation, a vacuum is generated in the canister by the means for generating a vacuum 64. An inlet valve (not shown) in communication with the canister and the canister manifold 542 and the means for generating a vacuum 64 is opened. An inlet valve in communication with the color changer 530 and the canister manifold 542 is closed. An outlet valve in communication with the canister and an applicator 524 is also closed. The means for generating a vacuum 64 is then caused to generate the vacuum in the canister, thereby drawing air from the canister as a piston slidably disposed in the canister is drawn towards a first end thereof. With the air removed from the canister the inlet valve in communication with the color changer 530 and the canister manifold 542 is opened, paint is caused to flow from the bulk supply of paint through the paint lines, through a desired color valve 538, through the color changer 530, through the isolation line 540, through the canister manifold 542, and into the canister. Filling the canister with paint after air is removed from the canister, and without introducing air back into the canister, eliminates the need for a bleed operation adapted to remove air from the painting system, thereby minimizing paint waste. Once the paint fills the flow path, the pressure in the canister increases. As the pressure increases in the canister, the paint exerts a force on the piston and causes the piston to be moved away from the first end of the canister. The pressure on the piston is sensed and a feedback is provided. Once a desired feedback indicating the canister is filled, the inlet valve is closed.

After the filling operation, the canister is electrostatically charged and the painting operation, as known in the art, is performed. To clean the canister of the painting system after the painting operation, a solvent and air mixture is caused to flow through the canister manifold 542 and into the canister. The solvent and air mixture is then caused to flow from the canister, through the isolation line 540, through the valve disposed between the isolation line 540 and the dump line 541, through the dump line 541, and to the disposal system 562. Accordingly, the dump line 541 is not in direct contact with the electrically charged canister. Further, the dump line 541 is disposed downstream from the canister and the isolation line 540. Because the dump line 541 is isolated from the charged canister, the dump line 541 is not required to be thoroughly cleaned of paint residue to militate against electrostatic erosion caused by paint residue on the inner walls of the dump line 541.

Figure 7:
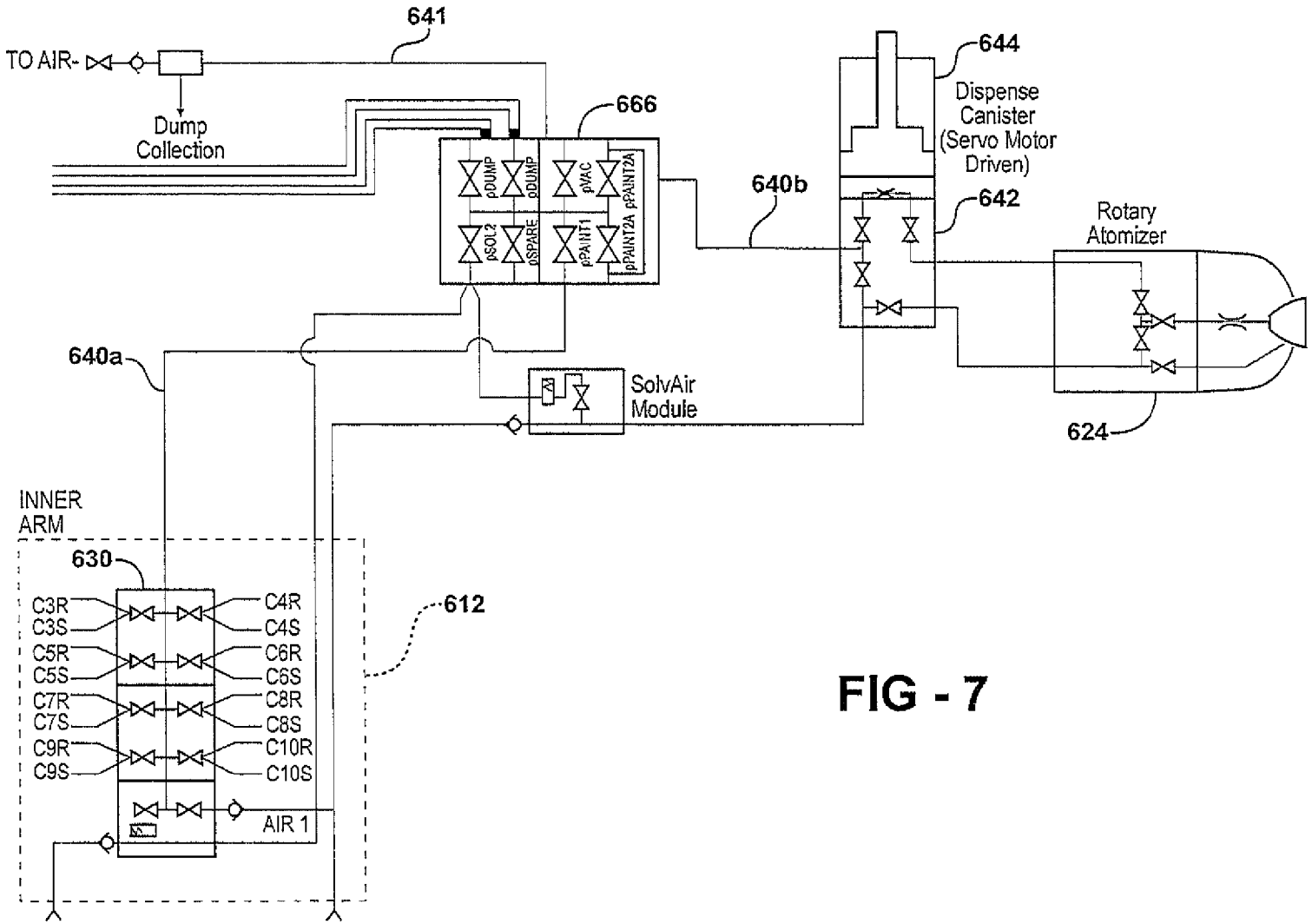
FIG. 7 is a fluidic schematic of a third embodiment of a painting system according the present invention.

FIG. 7 is a fluidic schematic of a third embodiment of a painting robot according the present invention wherein the distance between the color changer and the canister is longer than in the embodiments shown in FIGS. 1-6. For example, a color changer 630 can be mounted on an inner arm 612 instead of the outer arms 18 and 518. In this case, the isolation line can be split into a first portion 640*a* connecting the color changer 630 to an intermediate block 666, and a second portion 640*b* connecting the intermediate block 666 to a canister manifold 642 associated with a canister 644. A dump line 641 is connected to the color changer 630 through the intermediate block 666. The canister 644 supplies paint to a rotary atomizer applicator 624 as explained above with respect to the other embodiments. The intermediate block 666 can be mounted on the outer arm (not shown) for example.

Figure 8:
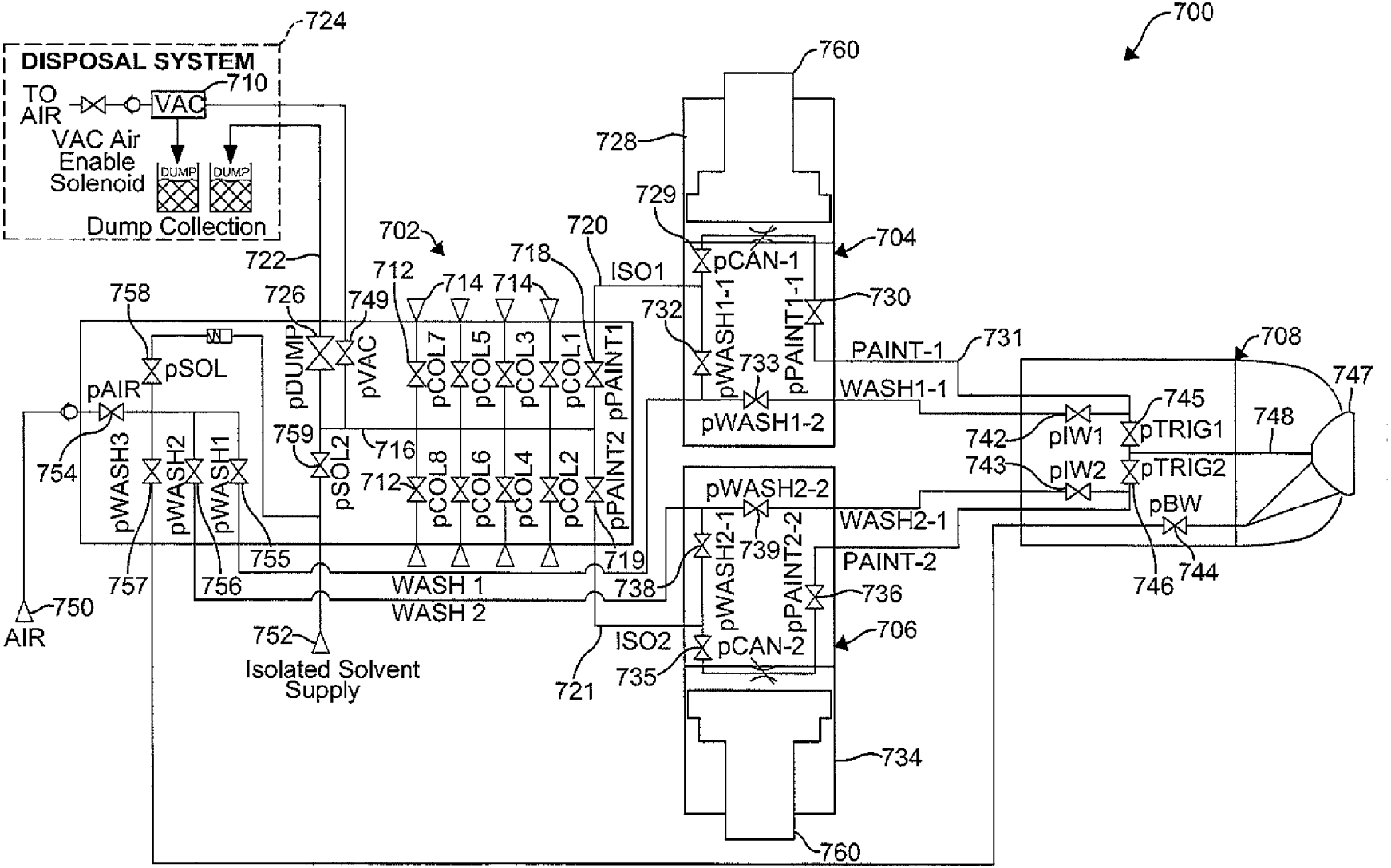
FIG. 8 is a fluidic schematic of a fourth embodiment of a painting system according the present invention.

FIG. 8 illustrates a fluidic schematic of a fourth embodiment of a robotic painting system 700 similar to the system 10 except as described herein below. As shown, the painting system 700 includes a color changer 702, a first canister manifold 704, a second canister manifold 706, an applicator 708, and a means for generating a vacuum 710.

The color changer 702 includes a plurality of electrically grounded color valves (pCOL1-pCOL8) 712. Each of the color valves 712 is disposed between an associated one of a plurality of incoming paint lines 714 and a main line 716 of the color changer 702. A pair of paint valves (pPAINT1, pPAINT2) 718, 719 are disposed between the main line 716 and each of the canister manifolds 704, 706 to control a flow of paint from the color changer 702 to each of the canister manifolds 704, 706. It is understood that the color changer 702 can be disposed in various positions and distances from the canister manifolds 704, 706.

As a non-limiting example, each of a pair of isolation lines 720, 721 is connected to an associated one of the paint valves 718, 719 to provide fluid communication between the color changer 702 and each of the canister manifolds 704, 706. The isolation lines 720, 721 are typically formed from fluorinated ethylene propylene (FEP). However, other materials can be used.

As a further non-limiting example, a dump line 722 provides fluid communication between the isolation lines 720, 721 and a disposal system 724. In certain embodiments, the dump line 722 is connected to the main line 716 of the color changer 702 via a dump valve (pDUMP) 726 to selectively control a flow of fluid from the isolation lines 720, 721 to the dump line 722 via the main line 716.

The first canister manifold 704 is in fluid communication with a first canister 728, wherein the first canister 728 can be electrically charged, yet electrostatically isolated from the grounded color valves 712 by the isolation line 720. The first canister manifold 704 includes a plurality of valves, namely, a first canister valve (pCAN-1) 729 to control a flow of paint from the isolation line 720 into the first canister 728, a first canister paint valve (pPAINT1-1) 730 to control a flow of paint to the applicator 708 via a first canister paint line 731, a first wash valve (pWASH1-1) 732 to control a flow of fluid through the first canister manifold 704 to the isolation line 720, and a second wash valve (pWASH1-2) 733 to control a flow of fluid through the first canister manifold 704 to the applicator 708.

The second canister manifold 706 is in fluid communication with a second canister 734, wherein the second canister 734 can be electrically charged, yet electrostatically isolated from the grounded color valves 712 by the isolation line 721. The second canister manifold 706 includes a plurality of valves, namely, a second canister valve (pCAN-2) 735 to control a flow of paint from the isolation line 721 into the second canister 734, a second canister paint valve (pPAINT2-2) 736 to control a flow of paint to the applicator 708 via a paint line 737, a first wash valve (pWASH2-1) 738 to control a flow of fluid through the second canister manifold 706 to the isolation line 721, and a second wash valve (pWASH2-2) 739 to control a flow of fluid through the second canister manifold 706 to the applicator 708.

In the embodiment shown, the applicator 708 is a rotary bell applicator including an applicator manifold 740 having a plurality of control valves 742, 743, 744, 745, 746. Each of the valves (pIW1, pIW2) 742, 743 are in fluid communication with an associated one of the second wash valves 733, 739 of the canister manifolds 704, 706 to allow cleaning fluids/air into the applicator 708. The valve (pBW) 744 selectively controls a flow of a cleaning fluid/air to an atomizing equipment 747 of the applicator 708. The valves (pTRIG1, pTRIG2) 745, 746 are trigger valves in fluid communication with the paint valves 730, 736 to control the flow of paint from each of the canister manifolds 704, 706 to the atomizing equipment of the applicator 708. As shown, an injector path 748 is disposed between the atomizing equipment 747 and each of the valves 745, 746 to facilitate the flow of paint from each of the canister manifolds 704, 706 to the atomizing equipment 747.

In the embodiment shown, the means for generating a vacuum 710 is a venturi-type vacuum generator. However, the means for generating a vacuum 710 may be any conventional device adapted to generate a vacuum. The means for generating a vacuum 710 is in fluid communication with an interior of each of the canisters 728, 734. As a non-limiting example, the means for generating a vacuum 710 is in fluid communication with the main line of the color changer via a vacuum valve (pVAC) 749 As a non-limiting example, the means for generating a vacuum 710 is disposed adjacent the disposal system 724. It is understood that the means for generating a vacuum 710 may be disposed on another portion of the painting system or remotely disposed, as desired.

In the embodiment shown, a supply of compressed air 750 and a supply of isolated solvent 752 are in fluid communication with the painting system 700 to execute various operational procedures. Specifically, the supply of compressed air 750 is routed through an air inlet valve (pAIR) 754 and distributed through a plurality of main wash valves (pWASH1, pWASH2, pWASH3) 755, 756, 757. The supply of isolated solvent 752 is routed through at least one of a pair of main solvent valves (pSOL, pSOL2) 758, 759. The solvent valve 758 is in fluid communication with each of the main wash valves 755, 756, 757 to distribute solvent to various passages through the painting system 700. The solvent valve 759 is in fluid communication with the main line 716 to push solvent therethrough. As a non-limiting example, the main wash valves 755, 756, 757 provided selective control of at least one of a compressed air and a cleaning solvent to at least one of the first canister manifold 704, the second canister manifold 706, and the applicator 708.

FIGS. 9 and 10 illustrate a plurality of valve configurations for various operational procedures executed using the painting system 700, wherein "O" On indicates that an associated valve is open. As a non-limiting example, to fill the first canister 728 of the painting system 700 in anticipation of a painting operation, a vacuum is generated in the canister by the means for generating a vacuum 710, as shown in steps 1-2. Specifically, the vacuum valve 749, the first canister paint valve 718, and the first canister valve 730 are opened. The first canister paint line 731 in communication with the first canister 728 and an applicator 708 is dosed. The means for generating a vacuum 710 is then caused to generate the vacuum in the first canister 728, thereby drawing air from the first canister 728 as a piston 760 slidably disposed in the first canister 728 is drawn towards the first canister manifold 704. With the air removed from the first canister 728 a desired one of the color valves 712 is opened and paint is caused to flow from a bulk supply of paint through the associated paint line 714, through the desired color valve 712, through the main line 716 of the color changer 702, through the isolation line 720, through the first canister manifold 704, and into the first canister 728. Filling the first canister 728 with paint after air is removed therefrom, and without introducing air back into the first canister 728, eliminates the need for a bleed operation adapted to remove air from the painting system 700, thereby minimizing paint waste. Once the paint fills the flow path, a pressure in the first canister 728 increases. As the pressure increases in the first canister 728, the paint exerts a force on the piston 760 and causes the piston 760 to be moved away from the first canister manifold 704. The pressure on the piston 760 is sensed and a feedback is provided, wherein the feedback represents an amount of paint in the first canister 728.

After the filling operation, the first canister 728 is electrostatically charged and painting operation is performed, as shown in steps 6-9. To clean the first canister 728 of the painting system 700 after the painting operation, a solvent and air mixture is caused to flow through the first canister manifold 704 and into the first canister 728. The solvent and air mixture is then caused to flow from the first canister 728, through the isolation line 720, through the paint valve 718, through the main line 716, through the dump line 722, and to the disposal system 724. Accordingly, the dump line 722 is not in direct contact with the electrically charged first canister 728. Because the dump line 722 is isolated from the charged canister, the dump line 722 is not required to be thoroughly cleaned of paint residue to militate against electrostatic erosion caused by paint residue on the inner walls of the dump line 722. It is understood that the dump line 722 to the disposal system 724 is not required to be isolated and can be directly connected to the disposal system 724.

It is understood that painting system 700 including the first canister 728 and the second canister 734 minimizes a color change time and a paint waste. Each of the paint lines 731, 737 between the canisters 728, 734 and the applicator 708 can be isolated (i.e. cleaned and dried) and then the associated one of the canisters 728, 734 can be further cleaned, dried, and filled while the other one of the canisters 728, 734 is dispensing paint.

Figure 11:
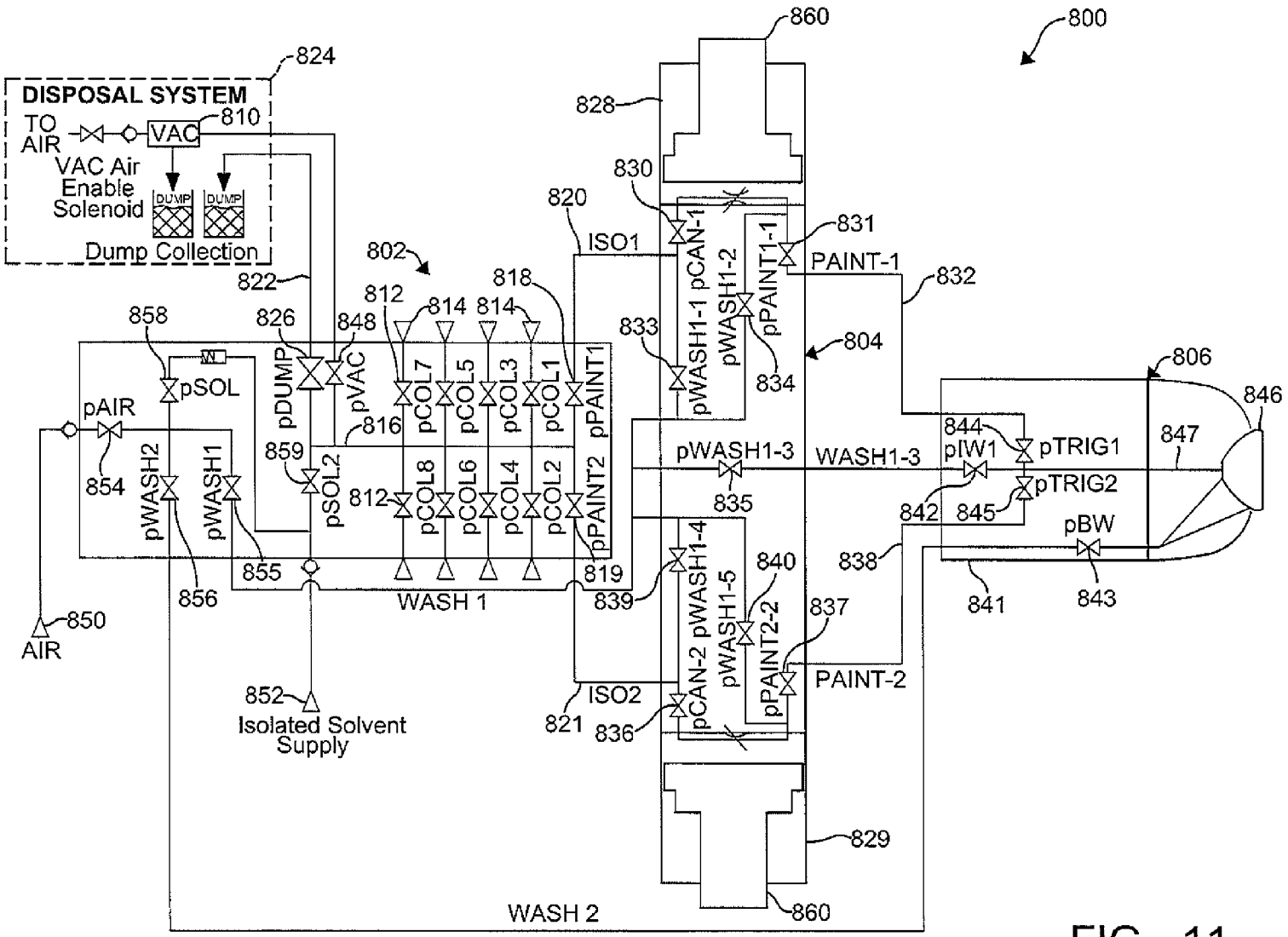
FIG. 11 is a fluidic schematic of a fifth embodiment of a painting system according the present invention.

FIG. 11 illustrates a fluidic schematic of a fifth embodiment of a painting robot 800 according the present invention similar to the painting robot 700 except as described herein below. The painting robot 800 includes a color changer 802, a canister manifold 804, an applicator 806, and a means for generating a vacuum 810.

The color changer 802 includes a plurality of electrically grounded color valves (pCOL1-pCOL8) 812. Each of the color valves 812 is disposed between an associated one of a plurality of incoming paint lines 814 and a main line 816 of the color changer 802. A pair of paint valves (pPAINT1, pPAINT2) 818, 819 are in disposed between the main line 816 and the canister manifold 804 to control a flow of paint from the color changer 802 to the canister manifolds 804.

As a non-limiting example, each of a pair of isolation lines 820, 821 is connected to an associated one of the paint valves 818, 819 to provide fluid communication between the color changer 802 and the canister manifold 804. The isolation lines 820, 821 are typically formed from fluorinated ethylene propylene (FEP).

As a further non-limiting example, a dump line 822 provides fluid communication between the isolation lines 820, 821 and a disposal system 824. In certain embodiments, the dump line 822 is connected to the main line 816 of the color changer 802 via a dump valve (pDUMP) 826 to selectively control a flow of fluid from the isolation lines 820, 821 to the dump line 822 via the main line 816.

The canister manifold 804 is in fluid communication with a first canister 828 and a second canister 829, wherein each of the canisters 828, 829 can be electrically charged, yet electrostatically isolated from the grounded color valves 812 by the isolation lines 820, 821. The canister manifold 804 includes a plurality of valves, namely, a first canister valve (pCAN-1) 830 to control a flow of paint from the isolation line 820 into the first canister 828, a paint valve (pPAINT1-1) 831 to control a flow of paint to the applicator 806 via a first canister paint line 832, a first wash valve (pWASH1-1) 833 to control a flow of fluid through the canister manifold 804 to the isolation line 820, a second wash valve (pWASH1-2) 834 to selectively control a flow of fluid through the first canister 828, a third wash valve (pWASH1-3) 835 to control a flow of fluid through the canister manifold 804 to the applicator 806, a second canister valve (pCAN-2) 836 to control a flow of paint from the isolation line 821 into the second canister 829, a paint valve (pPAINT2-2) 837 to control a flow of paint to the applicator 806, via a second canister paint line 838, a fourth wash valve (pWASH1-4) 839 to control a flow of fluid through the canister manifold 804 to the isolation line 821, and a fifth wash valve (pWASH1-5) 840 to selectively control a flow of fluid through the second canister 829.

In the embodiment shown, the applicator 806 is a rotary bell applicator including an applicator manifold 841 having a plurality of control valves 842, 843, 844, 845. The valve (pIW1) 842 is in fluid communication with the third wash valve 835 of the canister manifold 804 to allow cleaning fluids into the applicator 806. The valve (pBW) 843 selectively controls a flow of a cleaning fluid to an atomizing equipment 846 of the applicator 806. The valves (pTRIG1, pTRIG2) 844, 845 are trigger valves in fluid communication with the paint lines 832, 838 to control the flow of paint from each of the paint lines 832, 838 to the atomizing equipment 846 of the applicator 806. As shown, an injector line 847 is disposed between the atomizing equipment 846 and each of the trigger valves 844, 845 to facilitate the flow of paint from each of the paint lines 832, 838 to the atomizing equipment 846.

In the embodiment shown, the means for generating a vacuum 810 is a venturi-type vacuum generator. However, the means for generating a vacuum 810 may be any conventional device adapted to generate a vacuum. The means for generating a vacuum 810 is in fluid communication with an interior of each of the canisters 828, 829. As a non-limiting example, the means for generating a vacuum 810 is in fluid communication with the main line of the color changer via a vacuum valve (pVAC) 848 As a non-limiting example, the means for generating a vacuum 810 is disposed adjacent the disposal system 824. It is understood that the means for generating a vacuum 810 may be disposed on another portion of the painting system or remotely disposed, as desired.

In the embodiment shown, a supply of compressed air 850 and a supply of isolated solvent 852 are in fluid communication with the painting system 800 to execute various operational procedures. Specifically, the supply of compressed air 850 is routed through an air inlet valve (pAIR) 854 and distributed through a plurality of main wash valves (pWASH1, pWASH2) 855, 856. The supply of isolated solvent 852 is routed through at least one of a pair of main solvent valves (pSOL, pSOL2) 858, 859. The solvent valve 858 is in fluid communication with each of the main wash valves 855, 856 to distribute solvent to various passages through the painting system 800. The solvent valve 859 is in fluid communication with the main line 816 to push solvent therethrough. As a non-limiting example, the main wash valves 855, 856 provided selective control of at least one of a compressed air and a cleaning solvent to at least one of the canister manifold 804 and the applicator 806.

FIGS. 12 and 13 illustrate a plurality of valve configurations for various operational procedures executed using the painting system 800, wherein "O" indicates that an associated valve is open. As a non-limiting example, to fill the first canister 828 of the painting system 800 in anticipation of a painting operation, a vacuum is generated in the canister by the means for generating a vacuum 810, as shown in steps 1-2. Specifically, the vacuum valve 848, the first canister paint valve 818, and the first canister valve 830 are opened. The paint valve 831 in communication with the first canister paint line 832 is closed. The means for generating a vacuum 810 is then caused to generate the vacuum in the first canister 828, thereby drawing air from the first canister 828 as a piston 860 slidably disposed in the first canister 828 is drawn towards the canister manifold 804. With the air removed from the first canister 828 a desired one of the color valves 812 is opened and paint is caused to flow from a bulk supply of paint through the associated paint line 814, through the desired color valve 812, through the main line 816 of the color changer 802, through the isolation line 820, through the canister manifold 804, and into the first canister 828.

After the filling operation, the first canister 828 is electrostatically charged and painting operation is performed, as shown in steps 6-8. To clean the first canister 828 of the painting system 800 after the painting operation, a solvent and air mixture is caused to flow through the canister manifold 804 and into the first canister 828. The solvent and air mixture is then caused to flow from the first canister 828, through the isolation line 820, through the paint valve 818, through the main line 816, through the dump line 822, and to the disposal system 824. Accordingly, the dump line 822 is not in direct contact with the electrically charged first canister 828. Because the dump line 822 is isolated from the charged canister, the dump line 822 is not required to be thoroughly cleaned of paint residue to militate against electrostatic erosion caused by paint residue on the inner walls of the dump line 822.

Figure 14:
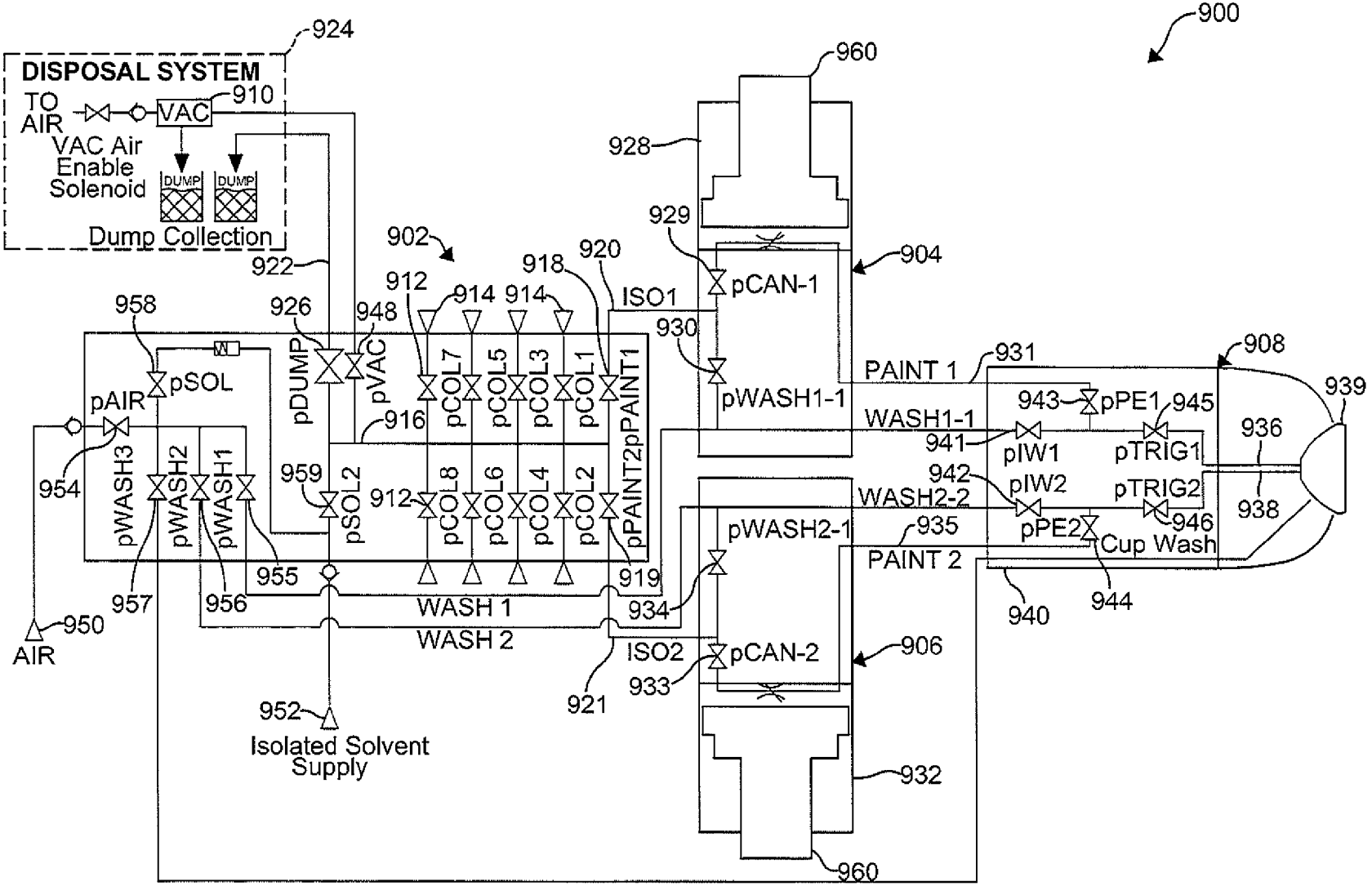
FIG. 14 is a fluidic schematic of a sixth embodiment of a painting system according the present invention.

FIG. 14 illustrates a fluidic schematic of a sixth embodiment of a painting robot 900 similar to the painting system 700 except as described herein below. The painting robot 900 includes a color changer 902, a first canister manifold 904, a second canister manifold 906, an applicator 908, and a means for generating a vacuum 910.

The color changer 902 includes a plurality of electrically grounded color valves (pCOL1-pCOL8) 912. Each of the color valves 912 is disposed between an associated one of a plurality of incoming paint lines 914 and a main line 916 of the color changer 902. A pair of paint valves (pPAINT1, pPAINT2) 918, 919 are in disposed between the main line 916 and each of the canister manifolds 904, 906 to control a flow of paint from the color changer 902 to each of the canister manifolds 904, 906.

As a non-limiting example, each of a pair of isolation lines 920, 921 is connected to an associated one of the paint valves 918, 919 to provide fluid communication between the color changer 902 and each of the canister manifolds 904, 906. The isolation lines 920, 921 are typically formed from fluorinated ethylene propylene (FEP). However, other materials can be used.

As a further non-limiting example, a dump line 922 provides fluid communication between the isolation lines 920, 921 and a disposal system 924. In certain embodiments, the dump line 922 is connected to the main line 916 of the color changer 902 via a dump valve (pDUMP) 926 to selectively control a flow of fluid from the isolation lines 920, 921 to the dump line 922 via the main line 916.

The first canister manifold 904 is in fluid communication with a first canister 928, wherein the first canister 928 can be electrically charged, yet electrostatically isolated from the grounded color valves 912 by the isolation line 920. The first canister manifold 904 includes a plurality of valves, namely, a first canister valve (pCAN-1) 929 to control a flow of paint from the isolation line 920 into the first canister 928 and a first wash valve (pWASH1-1) 930 to control a flow of fluid through the first canister manifold 904 to the isolation line 920. The first canister manifold 904 also includes a paint line 931 in fluid communication with the first canister 928 and the applicator 908.

The second canister manifold 906 is in fluid communication with a second canister 932, wherein the second canister 932 can be electrically charged, yet electrostatically isolated from the grounded color valves 912 by the isolation line 921. The second canister manifold 906 includes a plurality of valves, namely, a second canister valve (pCAN-2) 933 to control a flow of paint from the isolation line 921 into the second canister 932 and a first wash valve (pWASH2-1) 934 to control a flow of fluid through the second canister manifold 906 to the isolation line 920. The second canister manifold 906 also includes a paint line 935 in fluid communication with the second canister 932 and the applicator 908. It is understood that any of the paint lines 931, 935 can be cleaned and dried for electrostatic isolation from the other of the paint lines 931, 935.

In the embodiment shown, the applicator 908 is a rotary bell applicator including a first injector path 936 and a second injector path 938, each of the injector paths 936, 938 in fluid communication with an atomizing device 939 of the paint applicator 908. In certain embodiments, each of the injector paths 936, 938 is independent and insulated from each other and each of the injector paths 936, 938 can be electrically isolated from each other. As a non-limiting example, the injector paths 936, 938 are of suitable length and insulating properties such that when a select one of the injector paths 936, 938 is cleaned and dried, the select one of injector paths 936, 938 provides electrical isolation for the upstream fluid delivery system. It is understood that the injector paths 936, 938 provide two paths for simultaneous cleaning and filling functions, thereby reducing color change time.

The applicator 908 further includes an applicator manifold 940 having a plurality of control valves 941, 942, 943, 944, 945, 946. Each of the valves (pIW1, pIW2) 941, 942 allow cleaning fluids (or air) into the applicator 908. The valve (pPE1) 943 selectively controls a flow of paint from the paint line 931 to a fluid passage between the valve 941 and the valve 945. The valve (pPE2) 944 selectively controls a flow of paint from the paint line 935 to a fluid passage between the valve 942 and the valve 946. The valves (pTRIG1, pTRIG2) 945, 946 are trigger valves in fluid communication with the injector paths 936, 938 to control the flow of paint from each of the paint lines 931, 935 to the atomizing device 939 of the applicator 908.

In the embodiment shown, the means for generating a vacuum 910 is a venturi-type vacuum generator. However, the means for generating a vacuum 910 may be any conventional device adapted to generate a vacuum. The means for generating a vacuum 910 is in fluid communication with an interior of each of the canisters 928, 932. As a non-limiting example, the means for generating a vacuum 910 is in fluid communication with the main line of the color changer via a vacuum valve (pVAC) 948 As a non-limiting example, the means for generating a vacuum 910 is disposed adjacent the disposal system 924. It is understood that the means for generating a vacuum 910 may be disposed on another portion of the painting system or remotely disposed, as desired.

In the embodiment shown, a supply of compressed air 950 and a supply of isolated solvent 952 are in fluid communication with the painting system 900 to execute various operational procedures. Specifically, the supply of compressed air 950 is routed through an air inlet valve (pAIR) 954 and distributed through a plurality of main wash valves (pWASH1, pWASH2, pWASH3) 955, 956, 957. The supply of isolated solvent 952 is routed through at least one of a pair of main solvent valves (pSOL, pSOL2) 958, 959. The solvent valve 958 is in fluid communication with each of the main wash valves 955, 956, 957 to distribute solvent to various passages through the painting system 900. The solvent valve 959 is in fluid communication with the main line 916 to push solvent therethrough. As a non-limiting example, the main wash valves 955, 956, 957 provided selective control of at least one of a compressed air and a cleaning solvent to at least one of the first canister manifold 904, the second canister manifold 906, and the applicator 908.

FIGS. 15 and 16 illustrate a plurality of valve configurations for various operational procedures executed using the painting system 900, wherein "O" indicates that an associated valve is open. As a non-limiting example, to fill the first canister 928 of the painting system 900 in anticipation of a painting operation, a vacuum is generated in the canister by the means for generating a vacuum 910, as shown in steps 1-2. Specifically, the vacuum valve 948, the first canister paint valve 918, the first canister valve 930, and the valve 943 are opened. The trigger valve 945 is closed. The means for generating a vacuum 910 is then caused to generate the vacuum in the first canister 928, thereby drawing air from the first canister 928 as a piston 960 slidably disposed in the first canister 928 is drawn towards the first canister manifold 904. With the air removed from the first canister 928 a desired one of the color valves 912 is opened and paint is caused to flow from a bulk supply of paint through the associated paint line 914, through the desired color valve 912, through the main line 916 of the color changer 902, through the isolation line 920, through the first canister manifold 904, and into the first canister 928. Filling the first canister 928 with paint after air is removed therefrom, and without introducing air back into the first canister 928, eliminates the need for a bleed operation adapted to remove air from the painting system 900, thereby minimizing paint waste.

After the filling operation, the first canister 928 is electrostatically charged and a painting operation is performed (e.g. steps 6-9). To clean the first injector path 936 after the painting operation is complete, a solvent and air mixture is caused to flow therethrough, as shown in steps 10-11. To clean the first canister 928 of the painting system 900 after the painting operation, a solvent and air mixture is caused to flow through the first canister manifold 904 and into the first canister 928, as shown in steps 12-13. Specifically, a solvent and air mixture is caused to flow from the first canister 904, through the isolation line 920, through the main line 916, through the dump line 922, and to the disposal system 924. Accordingly, the dump line 922 is not in direct contact with the electrically charged first canister 928.

The painting system 900 including a first injector path 936 and a second injector path 938 provide a means for tip isolation in the applicator 908. Specifically, one of the injector paths 936, 938 is filled with conductive coating and the other of the injector paths 936, 938 is either clean and dry or filled with a non-conductive solvent or insulating material. High voltage can be applied to the applicator 908, thus charging the liquid-filled side, whereas the opposing side forms a voltage block. The voltage block allows one of the canisters 928, 932 (i.e. in fluid communication with the insulated one of the injector paths 936, 938) can be refilled with the same color or the cleaned and filled with a new color. It is understood that the paint lines 931, 935 can remain filled with paint thus reducing refill time and paint waste. It is further understood that painting system 900 minimizes color change time.

Figure 17:
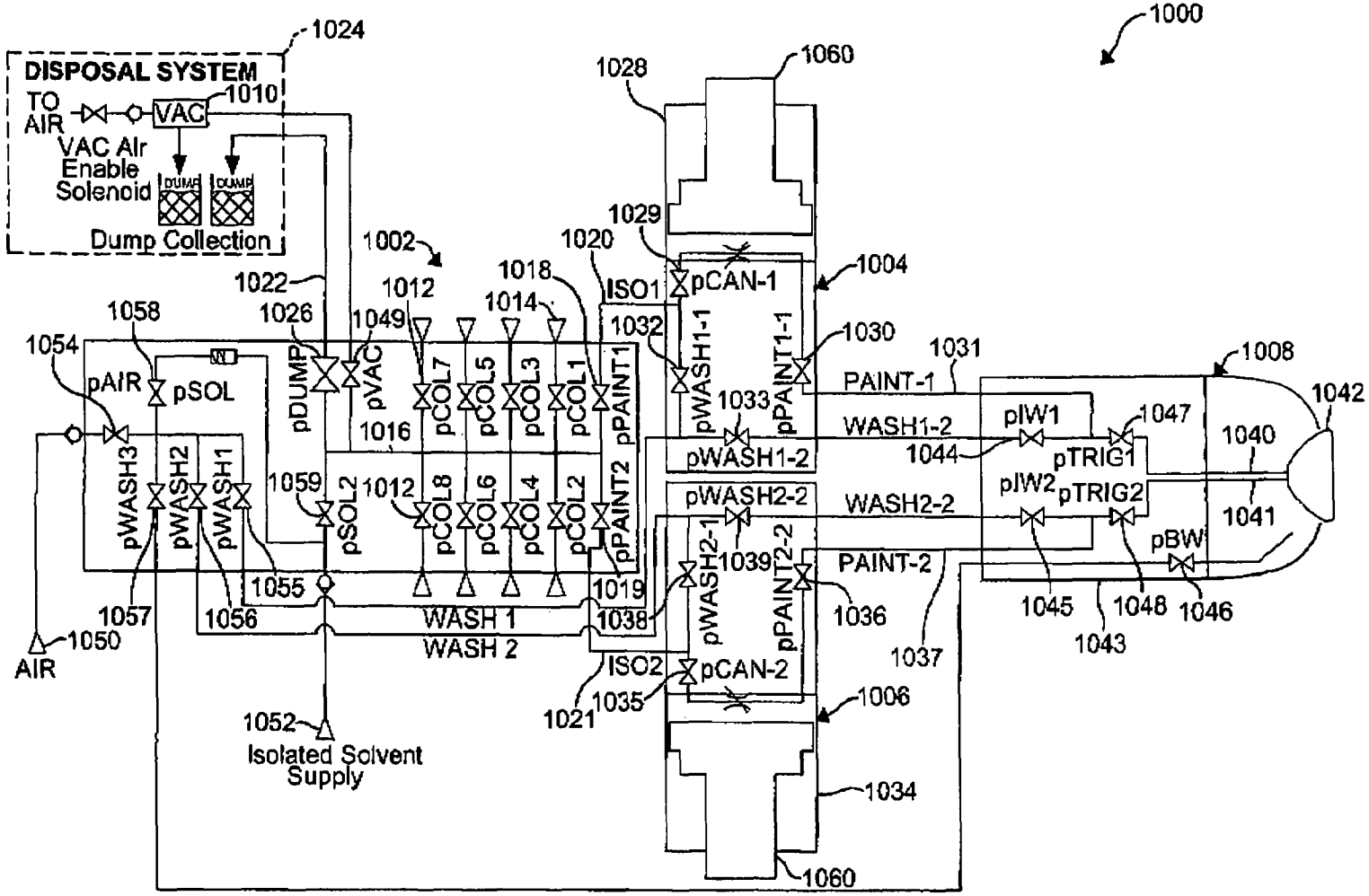
FIG. 17 is a fluidic schematic of a seventh embodiment of a painting system according the present invention.

FIG. 17 illustrates a fluidic schematic of a seventh embodiment of a painting system 1000 similar to the painting system 900 except as described herein below. As shown, the painting system 1000 includes a color changer 1002, a first canister manifold 1004, a second canister manifold 1006, an applicator 1008, and a means for generating a vacuum 1010.

The color changer 1002 includes a plurality of electrically grounded color valves (pCOL1-pCOL8) 1012. Each of the color valves 1012 is disposed between an associated one of a plurality of incoming paint lines 1014 and a main line 1016 of the color changer 1002. A pair of paint valves (pPAINT1, pPAINT2) 1018, 1019 are in disposed between the main line 1016 and each of the canister manifolds 1004, 1006 to control a flow of paint from the color changer 1002 to each of the canister manifolds 1004, 1006.

As a non-limiting example, each of a pair of isolation lines 1020, 1021 is connected to an associated one of the paint valves 1018, 1019 to provide fluid communication between the color changer 1002 and each of the canister manifolds 1004, 1006. The isolation lines 1020, 1021 are typically formed from fluorinated ethylene propylene (FEP). However, other materials can be used.

As a further non-limiting example, a dump line 1022 provides fluid communication between the isolation lines 1020, 1021 and a disposal system 1024. In certain embodiments, the dump line 1022 is connected to the main line 1016 of the color changer 1002 via a dump valve (pDUMP) 1026 to selectively control a flow of fluid from the isolation lines 1020, 1021 to the dump line 1022 via the main line 1016.

The first canister manifold 1004 is in fluid communication with a first canister 1028, wherein the first canister 1028 can be electrically charged, yet electrostatically isolated from the grounded color valves 1012 by the isolation line 1020. The first canister manifold 1004 includes a plurality of valves, namely, a first canister valve (pCAN-1) 1029 to control a flow of paint from the isolation line 1020 into the first canister 1028, a first canister paint valve (pPAINT1-1) 1030 to control a flow of paint to the applicator 1008 via a paint line 1031, a first wash valve (pWASH1-1) 1032 to control a flow of fluid through the first canister manifold 1004 to the isolation line 1020, and a second wash valve (pWASH1-2) 1033 to control a flow of fluid through the first canister manifold 1004 to the applicator 1008.

The second canister manifold 1006 is in fluid communication with a second canister 1034, wherein the second canister 1034 can be electrically charged, yet electrostatically isolated from the grounded color valves 1012 by the isolation line 1021. The second canister manifold 1006 includes a plurality of valves, namely, a second canister valve (pCAN-2) 1035 to control a flow of paint from the isolation line 1021 into the second canister 1034, a second canister paint valve (pPAINT2-2) 1036 to control a flow of paint to the applicator 1008 via a paint line 1037, a first wash valve (pWASH2-1) 1038 to control a flow of fluid through the second canister manifold 1006 to the isolation line 1020, and a second wash valve (pWASH2-2) 1039 to control a flow of fluid through the second canister manifold 1006 to the applicator 1008.

In the embodiment shown, the applicator 1008 is a rotary bell applicator including a first injector path 1040 and a second injector path 1041 in fluid communication with an atomizing device 1042 of the paint applicator 1008. Each of the injector paths 1040, 1041 is independent and insulated from each other and each of the injector paths 1040, 1041 can be electrically isolated from each other. As a non-limiting example, the injector paths 1040, 1041 are of suitable length and insulating properties such that when a select one of the injector paths 1040, 1041 is cleaned and dried, the select one of injector paths 1040, 1041 provides electrical isolation for the upstream fluid delivery system. It is understood that the injector paths 1040, 1041 provide two paths for simultaneous cleaning and filling functions, thereby reducing color change time.

The applicator 1008 further includes an applicator manifold 1043 having a plurality of control valves 1044, 1045, 1046, 1047, 1048. Each of the valves (pIW1, pIW2) 1044, 1045 allow cleaning fluids into the applicator 1008. The valve (pBW) 1046 selectively controls a flow of a cleaning fluid to the atomizing equipment of the applicator 1002.The valves (pTRIG1, pTRIG2) 1047, 1048 are trigger valves in fluid communication with the injector paths 1040, 1041 to control the flow of paint from each of the paint lines 1031, 1035 to the atomizing device 1042 of the applicator 1008. As a non-limiting example, the paint line 1031 is in fluid communication with a fluid passage between the valve 1044 and the valve 1047. As a further non-limiting example, the paint line 1037 is in fluid communication with a fluid passage between the valve 1045 and the valve 1048.

In the embodiment shown, the means for generating a vacuum 1010 is a venturi-type vacuum generator. However, the means for generating a vacuum 1010 may be any conventional device adapted to generate a vacuum. The means for generating a vacuum 1010 is in fluid communication with an interior of each of the canisters 1028, 1034. As a non-limiting example, the means for generating a vacuum 1010 is in fluid communication with the main line of the color changer via a vacuum valve (pVAC) 1049 As a non-limiting example, the means for generating a vacuum 1010 is disposed adjacent the disposal system 1024. It is understood that the means for generating a vacuum 1010 may be disposed on another portion of the painting system or remotely disposed, as desired.

In the embodiment shown, a supply of compressed air 1050 and a supply of isolated solvent 1052 are in fluid communication with the painting system 1000 to execute various operational procedures. Specifically, the supply of compressed air 1050 is routed through an air inlet valve (pAIR) 1054 and distributed through a plurality of main wash valves (pWASH1, pWASH2, pWASH3) 1055, 1056, 1057. The supply of isolated solvent 1052 is routed through at least one of a pair of main solvent valves (pSOL, pSOL2) 1058, 1059. The solvent valve 1058 is in fluid communication with each of the main wash valves 1055, 1056, 1057 to distribute solvent to various passages through the painting system 1000. The solvent valve 1059 is in fluid communication with the main line 1016 to push solvent therethrough. As a non-limiting example, the main wash valves 1055, 1056, 1057 provided selective control of at least one of a compressed air and a cleaning solvent to at least one of the first canister manifold 1004, the second canister manifold 1006, and the applicator 1008.

FIGS. 18 and 19 illustrate a plurality of valve configurations for various operational procedures executed using the painting system 1000, wherein "O" indicates that an associated valve is open. As a non-limiting example, to fill the first canister 1028 of the painting system 1000 in anticipation of a painting operation, a vacuum is generated in the canister by the means for generating a vacuum 1010, as shown in steps 1-2. Specifically, the vacuum valve 1049, the first canister paint valve 1018, the first canister valve 1029, and the paint valve 1030 are opened. The trigger valve 1047 is closed. The means for generating a vacuum 1010 is then caused to generate the vacuum in the first canister 1028, thereby drawing air from the first canister 1028 as a piston 1060 slidably disposed in the first canister 1028 is drawn towards the first canister manifold 1004. With the air removed from the first canister 1028 a desired one of the color valves 1012 is opened and paint is caused to flow from a bulk supply of paint through the associated paint line 1014, through the desired color valve 1012, through the main line 1016 of the color changer 1002, through the isolation line 1020, through the first canister manifold 1004, and into the first canister 1028.

After the filling operation, the first canister 1028 is electrostatically charged and a painting operation is performed (e.g. steps 6-9). To clean the first injector path 1040 after the painting operation is complete, a solvent and air mixture is caused to flow therethrough, as shown in steps 10-11. To clean the first canister 1028 of the painting system 1000 after the painting operation, a solvent and air mixture is caused to flow through the first canister manifold 1004 and into the first canister 1028, as shown in steps 12-13. Specifically, a solvent and air mixture is caused to flow from the first canister 1004, through the isolation line 1020, through the main line 1016, through the dump line 1022, and to the disposal system 1024. Accordingly, the dump line 1022 is not in direct contact with the electrically charged first canister 1028.

The painting system 1000 including a first injector path 1040 and a second injector path 1041 provide a means for tip isolation in the applicator 1008. Specifically, one of the injector paths 1040, 1041 is filled with conductive coating and the other of the injector paths 1040, 1041 is either clean and dry or filled with a non-conductive solvent or insulating material. High voltage can be applied to the applicator 1008, thus charging the liquid-filled side, whereas the opposing side forms a voltage block. The voltage block allows one of the canisters 1028, 1034 (i.e. in fluid communication with the insulated one of the injector paths 1040, 1041) can be refilled with the same color or the cleaned and filled with a new color. It is understood that the paint lines 1031, 1035 can remain filled with paint thus reducing refill time and paint waste. It is further understood that painting system 1000 minimizes color change time.

Figure 20:
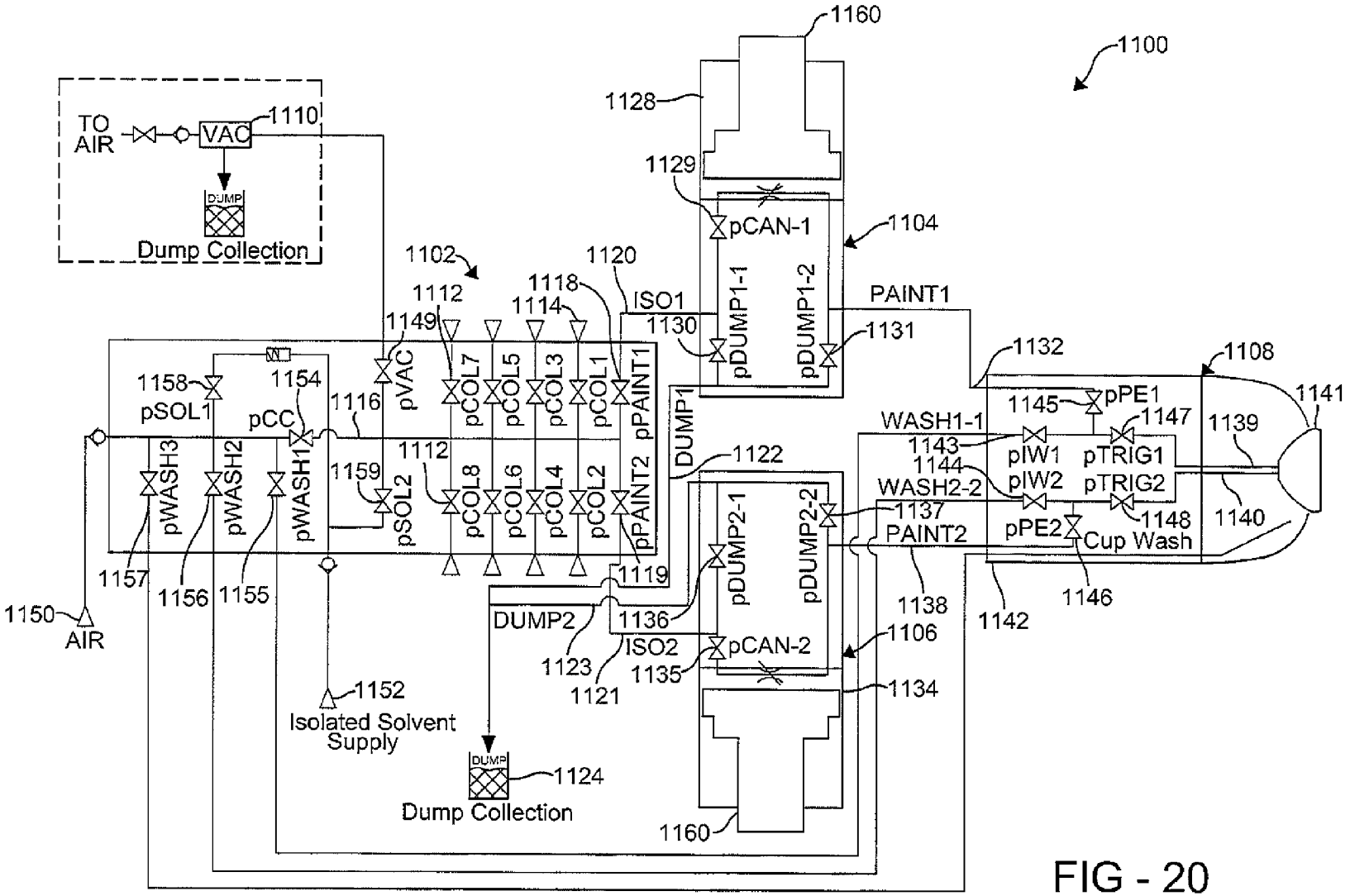
FIG. 20 is a fluidic schematic of an eighth embodiment of a painting system according the present invention.

FIG. 20 illustrates a fluidic schematic of an eighth embodiment of a painting system 1100 similar to the system 900 except as described herein below. As shown, the painting system 1100 includes a color changer 1102, a first canister manifold 1104, a second canister manifold 1106, an applicator 1108, and a means for generating a vacuum 1110.

The color changer 1102 includes a plurality of electrically grounded color valves (pCOL1-pCOL8) 1112. Each of the color valves 1112 is disposed between an associated one of a plurality of incoming paint lines 1114 and a main line 1116 of the color changer 1102. A pair of paint valves (pPAINT1, pPAINT2) 1118, 1119 are in disposed between the main line 1116 and each of the canister manifolds 1104, 1106 to control a flow of paint from the color changer 1102 to each of the canister manifolds 1104, 1106.

As a non-limiting example, each of a pair of isolation lines 1120, 1121 is connected to an associated one of the paint valves 1118, 1119 to provide fluid communication between the color changer 1102 and each of the canister manifolds 1104, 1106. The isolation lines 1120, 1121 are typically formed from fluorinated ethylene propylene (FEP). However, other materials can be used.

As a further non-limiting example, each of a pair of dump lines 1122, 1123 are in fluid communication with at least one of the canister manifolds 1104, 1106 to route fluids to a dump collection device 1124.

The first canister manifold 1104 is in fluid communication with a first canister 1128, wherein the first canister 1128 can be electrically charged, yet electrostatically isolated from the grounded color valves 1112 by the isolation line 1120. The first canister manifold 1104 includes a plurality of valves, namely, a first canister valve (pCAN-1) 1129 to control a flow of paint from the isolation line 1120 into the first canister 1128, a first dump valve (pDUMP1-1) 1130 to control a flow of fluid from the isolation line 1120 to the dump line 1122, and a second dump valve (pDUMP1-2) 1131 to control a flow of fluid from the canister 1128 to the dump line 1122. The first canister manifold 1104 also includes a paint line 1132 in fluid communication with the first canister 1128 and the applicator 1108.

The second canister manifold 1106 is in fluid communication with a second canister 1134, wherein the second canister 1134 can be electrically charged, yet electrostatically isolated from the grounded color valves 1112 by the isolation line 1121. The second canister manifold 1106 includes a plurality of valves, namely, a second canister valve (pCAN-2) 1135 to control a flow of paint from the isolation line 1121 into the second canister 1134, a first dump valve (pDUMP2-1) 1136 to control a flow of fluid from the isolation line 1121 to the dump line 1123, and a second dump valve (pDUMP2-2) 1137 to control a flow of fluid from the canister 1134 to the dump line 1123. The second canister manifold 1106 also includes a paint line 1138 in fluid communication with the second canister 1134 and the applicator 1108. It is understood that any of the paint lines 1132, 1138 can be cleaned and dried for electrostatic isolation from the other of the paint lines 1132, 1138.

In the embodiment shown, the applicator 1108 is a rotary bell applicator including a first injector path 1139 and a second injector path 1140 in fluid communication with an atomizing device 1141 of the paint applicator 1108. Each of the injector paths 1139, 1140 is independent and insulated from each other and each of the injector paths 1139, 1140 can be electrically isolated from each other.

The applicator 1108 further includes an applicator manifold 1142 having a plurality of control valves 1143, 1144, 1145, 1146, 1147, 1148. Each of the valves (pIW1, pIW2) 1143, 1144 allow cleaning fluids into the applicator 1108. The valve (pPE1) 1145 selectively controls a flow of paint from the paint line 1132 to a fluid passage between the valve 1143 and the valve 1147. The valve (pPE1) 1146 selectively controls a flow of paint from the paint line 1138 to a fluid passage between the valve 1144 and the valve 1148. The valves (pTRIG1, pTRIG2) 1147, 1148 are trigger valves in fluid communication with the injector paths 1139, 1140 to control the flow of paint from each of the paint lines 1132, 1138 to the atomizing device 1141 of the applicator 1108.

In the embodiment shown, the means for generating a vacuum 1110 is a venturi-type vacuum generator. However, the means for generating a vacuum 1110 may be any conventional device adapted to generate a vacuum. The means for generating a vacuum 1110 is in fluid communication with an interior of each of the canisters 1128, 1134. As a non-limiting example, the means for generating a vacuum 1110 is in fluid communication with the main line of the color changer via a vacuum valve (pVAC) 1149.

In the embodiment shown, a supply of compressed air 1150 and a supply of isolated solvent 1152 are in fluid communication with the painting system 1100 to execute various operational procedures. Specifically, the supply of compressed air 1150 is routed through a valve (pCC) 1154 in communication with the main line 1116. Air can also be distributed through a plurality of main wash valves (pWASH1, pWASH2, pWASH3) 1155, 1156, 1157. The supply of isolated solvent 1152 is routed through at least one of a pair of main solvent valves (pSOL, pSOL2) 1158, 1159. The solvent valve 1158 is in fluid communication with each of the main wash valves 1155, 1156, 1157 to distribute solvent to various passages through the painting system 1100. The solvent valve 1159 is in fluid communication with the main line 1116 to push solvent therethrough. As a non-limiting example, the main wash valves 1155, 1156, 1157 provided selective control of at least one of a compressed air and a cleaning solvent to at least one of the first canister manifold 1104, the second canister manifold 1106, and the applicator 1108.

FIGS. 21 and 22 illustrate a plurality of valve configurations for various operational procedures executed using the painting system 1100, wherein "O" indicates that an associated valve is open. As a non-limiting example, to fill the first canister 1128 of the painting system 1100 in anticipation of a painting operation, a vacuum is generated in the canister by the means for generating a vacuum 1110, as shown in steps 1-2. Specifically, the vacuum valve 1149, the first canister paint valve 1118, the first canister valve 1129, and the valve 1145 are opened. The trigger valve 1047 and the valve 1143 are closed. The means for generating a vacuum 1110 is then caused to generate the vacuum in the first canister 1128, thereby drawing air from the first canister 1128 as a piston 1160 slidably disposed in the first canister 1128 is drawn towards the first canister manifold 1104. With the air removed from the first canister 1128 a desired one of the color valves 1112 is opened and paint is caused to flow from a bulk supply of paint through the associated paint line 1114, through the desired color valve 1112, through the main line 1116 of the color changer 1102, through the isolation line 1120, through the first canister manifold 1104, and into the first canister 1128.

After the filling operation, the first canister 1128 is electrostatically charged and a painting operation is performed (e.g. steps 6-9). To clean the first injector path 1139 after the painting operation is complete, a solvent and air mixture is caused to flow therethrough, as shown in steps 10-11. To clean the first canister 1128 of the painting system 1100 after the painting operation, a solvent and air mixture is caused to flow through the first canister manifold 1104 and into the first canister 1128, as shown in steps 12-13. Specifically, a solvent and air mixture is caused to flow from the main line 1116, through the isolation line 1120, through the first canister 1128, through the second dump valve 1020, through the dump line 1122, and to the dump collection device 1124.

The painting system 1100 including a first injector path 1139 and a second injector path 1140 provide a means for tip isolation in the applicator 1108. Specifically, one of the injector paths 1139, 1140 is filled with conductive coating and the other of the injector paths 1139, 1140 is either clean and dry or filled with a non-conductive solvent or insulating material. High voltage can be applied to the applicator 1108, thus charging the liquid-filled side, whereas the opposing side forms a voltage block. The voltage block allows one of the canisters 1128, 1134 (i.e. in fluid communication with the insulated one of the injector paths 1139, 1140) can be refilled with the same color or the cleaned and filled with a new color. It is understood that the paint lines 1132, 1138 can remain filled with paint thus reducing refill time and paint waste. It is further understood that painting system 1100 minimizes color change time.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A painting system comprising:

an outer robot arm moveable within a spray booth;

an at least two-axis wrist with one end attached to the robot arm;

a paint applicator attached to an other end of the at least two-axis wrist;

a first paint metering device mounted on the robot arm and including an inlet and an outlet, wherein the outlet is in fluid communication with the paint applicator via a first paint line;

a second paint metering device mounted on the robot arm and including an inlet and an outlet, wherein the outlet is in fluid communication with the paint applicator via a second paint line; and a color changer mounted on the robot arm and in fluid communication with each of inlets of the paint metering devices to fill at least one of the paint metering devices with a desired amount of paint, wherein each of the paint metering devices is electrostatically isolated from the color changer and wherein a vacuum is subjected to at least one of the internal passages of the paint applicator, the first paint metering device, the second paint metering device, the color changer, and related fluid connections to remove an amount of air prior to causing paint to flow therethrough.

2. The system according to claim 1, wherein the paint applicator includes a first injector path and a second injector path in fluid communication with an atomizing device of the paint applicator, wherein each of the injector paths is independent and insulated from each other and each of the injector paths can be electrically isolated from each other.

3. The system according to claim 1, wherein at least one of the paint metering devices is a servo motor controlled paint canister.

4. The system according to claim 1, wherein a cleaning solvent and compressed air are supplied to a point downstream of the outlet of at least one of the paint metering devices, and wherein a dump valve is located upstream of the inlet of the at least one of the paint metering devices such that a fluid connection between the at least one of the paint metering devices and the color changer can be cleaned and dried in a reverse direction of the paint supply flow to the at least one of the paint metering devices for the purpose of electrostatic isolation.

5. The system according to claim 1, wherein a cleaning solvent and compressed air are supplied to a point of the fluid connection between at least one of the paint metering devices and the color changer, and wherein the color changer has a dump valve configured such that the fluid connection can be cleaned and dried in a reverse direction of the paint supply flow to the at least one of the paint metering devices for the purpose of electrostatic isolation.

6. The system according to claim 1, wherein a solvent is used to push paint from the color changer in a direction of a paint supply to at least one of the paint metering devices inlet.

7. The system according to claim 1, wherein a channel is formed between an inlet and an outlet of at least one of the paint metering devices such that a fluid path is formed when a canister piston is pushed fully forward.

8. The system according to claim 3, wherein an electrical feedback from the servo motor driving a piston is used to plot a positive force or a negative force on the piston with respect to time, wherein a slope of the feedback response is used to determine when the paint hits an injector tip, thereby indicating that the system is adequately primed prior to moving to a next step in a filling sequence.

9. The system according to claim 3, wherein each of the paint lines can be isolated to allow an associated one of the paint metering devices to be at least one of cleaned, dried, and filled while the other one of the paint metering devices is dispensing paint.

10. A painting system comprising:

a robot arm moveable within a spray booth;

a paint applicator coupled to the robot arm and including a first injector path and a second injector path in fluid communication with an atomizing device of the paint applicator, wherein each of the injector paths is independent and insulated from each other and each of the injector paths can be electrically isolated from each other;

a color changer mounted on the robot arm;

a first paint metering device mounted on the robot arm and including an inlet and an outlet, wherein the outlet is in fluid communication with the first injector path of the paint applicator and the inlet is in fluid communication with a paint supply through the color changer; and a second paint metering device mounted on the robot arm and including an inlet and an outlet, wherein the outlet is in fluid communication with the second injector path of the paint applicator and the inlet is in fluid communication with the paint supply through the color changer, and wherein each of the injector paths is located between one of the first paint metering device and the second paint metering device, and the atomizing device of the paint applicator.

11. The system according to claim 10, wherein the robot arm includes an at least two-axis wrist with one end attached to the robot arm and the paint applicator attached to an opposite end of the at least two-axis wrist.

12. The system according to claim 10, wherein a vacuum is subjected to at least one of the internal passages of the paint applicator, one of the paint metering devices, and related fluid connections to remove an amount of air prior to causing paint to flow therethrough.

13. The system according to claim 10, wherein each of the paint metering devices is a servo motor controlled paint canister.

14. The system according to claim 10, wherein for each of the paint metering devices a cleaning solvent and compressed air are supplied to a point downstream of the outlet of the paint metering device, and wherein a dump valve is located upstream of the paint metering device such that a fluid connection between the paint metering device and the paint supply can be cleaned and dried in a reverse direction of the paint supply flow to the paint metering device for the purpose of electrostatic isolation.

15. The system according to claim 10, wherein one of the injector paths is filled with a paint and the other of the injector paths is insulated to create a voltage block in the paint applicator.

16. The system according to claim 10, wherein the injector paths are electrically isolated from each other within a body of the paint applicator.

* * * * *